US012560038B2

(12) United States Patent
West et al.

(10) Patent No.: US 12,560,038 B2
(45) Date of Patent: Feb. 24, 2026

(54) CORE SAMPLE HANDLING DEVICE

(71) Applicant: COREMAX LIMITED, Hamilton (NZ)

(72) Inventors: Gregory Donald West, Hamilton (NZ); Peter Evan Powell, Hamilton (NZ)

(73) Assignee: COREMAX LIMITED, Hamilton (NZ)

( * ) Notice: Subject to any disclaimer, the term of this patent is extended or adjusted under 35 U.S.C. 154(b) by 0 days.

(21) Appl. No.: 18/255,441

(22) PCT Filed: Nov. 26, 2021

(86) PCT No.: PCT/NZ2021/050210

§ 371 (c)(1),
(2) Date: Jun. 1, 2023

(87) PCT Pub. No.: WO2022/119455

PCT Pub. Date: Jun. 9, 2022

(65) Prior Publication Data

US 2024/0026746 A1 Jan. 25, 2024

(30) Foreign Application Priority Data

Dec. 3, 2020 (NZ) ..... 770690

(51) Int. Cl.

| | |
|---|---|
| ***E21B 25/02*** | (2006.01) |
| ***E21B 19/086*** | (2006.01) |
| ***E21B 19/16*** | (2006.01) |
| ***E21B 19/20*** | (2006.01) |
| ***E21B 25/00*** | (2006.01) |
| ***E21B 25/10*** | (2006.01) |

(52) U.S. Cl.
CPC ..... *E21B 25/02* (2013.01); *E21B 19/086* (2013.01); *E21B 19/163* (2013.01); *E21B 19/20* (2013.01); *E21B 25/005* (2013.01); *E21B 25/10* (2013.01)

(58) Field of Classification Search
CPC ..... E21B 25/02; E21B 25/005; E21B 25/10; E21B 19/086; E21B 19/163; E21B 19/20
See application file for complete search history.

(56) References Cited

U.S. PATENT DOCUMENTS

| | | | | |
|---|---|---|---|---|
| 10,329,857 B2 * | 6/2019 | Hunter | ..... | E21B 19/164 |
| 2003/0015322 A1 * | 1/2003 | Fotland | ..... | E21B 19/165 166/55 |

(Continued)

OTHER PUBLICATIONS

International Search Report and Written Opinion received for PCT/NZ2021/050210, mailed Jan. 20, 2022.

*Primary Examiner* — Nicole Coy
*Assistant Examiner* — Nicholas D Wlodarski
(74) *Attorney, Agent, or Firm* — Greer, Burns & Crain, Ltd

(57) ABSTRACT

A device for handling core samples during a core sample drilling operation is disclosed. In use the core sample is received in a string of inner tubes within a drill string. The device includes a clamp and a coupling mechanism. The clamp is configured to grip a lower inner tube below a joint between the lower inner tube and an adjacent upper inner tube of the string of inner tubes, with the lower tube received in the drill string and with the joint exposed above a top end of the drill string. The coupling mechanism is configured to engage the upper inner tube and/or the joint and operate to uncouple the upper inner tube from the lower inner tube.

15 Claims, 17 Drawing Sheets

(56) References Cited

U.S. PATENT DOCUMENTS

| | | | | |
|---|---|---|---|---|
| 2009/0178847 | A1 | 7/2009 | Nellessen, Jr. et al. | |
| 2015/0021092 | A1 | 1/2015 | Gleadowe et al. | |
| 2015/0211310 | A1* | 7/2015 | Evermark | E21B 17/042 166/85.1 |
| 2015/0226016 | A1 | 8/2015 | Delmar et al. | |
| 2016/0115751 | A1* | 4/2016 | Jelgert | E21B 7/02 166/380 |
| 2018/0195358 | A1* | 7/2018 | Quintana Martinez | E21B 10/02 |
| 2018/0363398 | A1* | 12/2018 | Hejleh | E21B 25/16 |
| 2021/0054701 | A1* | 2/2021 | Holck | E21B 44/10 |
| 2021/0115737 | A1* | 4/2021 | Toivola | E21B 19/155 |

* cited by examiner

CORE SAMPLE HANDLING DEVICE

RELATED APPLICATIONS

This application is based on the specification filed in relation to New Zealand Patent Application Number 770690, the entire contents of which are incorporated herein by reference.

BACKGROUND

This invention relates to a device for handling a core sample during a drilling operation, to recover and remove the core sample from a drill rig, and a method for drilling and recovering core samples from a formation.

A drill rig capable of rotating a hollow (doughnut shaped) diamond impregnated drill bit at high speed is generally used when drilling to recover a rock core sample. A core sample is recovered for analysis to determine if any valuable minerals are present. Due to the use of a diamond impregnated drill bit, the drilling process for recovering core samples is typically referred to as 'diamond drilling'.

The drill bit is attached to a hollow drill string made up of drill rods threaded together end-to-end. An inner tube is provided within the hollow drill string to receive and hold the drilled core sample as the drill string and drill bit are advanced into the ground. The drill rig is equipped with a wireline retrieval system allowing the core sample to be periodically pulled to the surface for geotechnical analyses. The wireline retrieval system includes an overshot system connected to a wireline winch to allow the core samples to be recovered from deep in the ground without needing to remove the drill rods from the ground.

Due to ground formations, the mast length on drill rigs, and safe handling requirements, the inner tube which holds the drilled core sample is typically provided in 3 metre or 6 metre lengths. A typical drilled sequence is:

i) Rotate and advance the drill bit and drill rods into the ground for a distance equal to the length of the inner tube (e.g. if a 3 meter inner tube is being used—then the driller operating the drill rig drills to a depth of 3 meters);

ii) Stop drilling and lower the overshot on a wireline down the inside of the thin walled drill rods. The overshot is a latching mechanism that connects to a spear point at the top of the inner tube.

iii) With the overshot attached to the spear point at the top of the inner tube, the wireline is wound back onto a drum to pull the overshot and inner tube to the surface, with the inner tube holding the drilled core sample therein;

iv) At the surface the core is removed from the inner tube for analysis;

v) The inner tube is lowered back down the inside of the drill rods to be received at the bottom of the drilled hole, just above the drill bit;

vi) An additional drill rod is attached to the top of the drill string, and drilling is restarted. A further distance is drilled, again equal to the length of the inner tube.

vii) The process of advancing the drill bit, drill rods and inner tube, removing the inner tube with core sample, returning the empty inner tube to the bottom of the hole and recommencing drilling is repeated until a desired drill depth is reached.

This system has been the industry standards for approximately 40 years and is effective albeit slow. The deeper the driller drills into the earth, the more time is spent lowering the overshot and retrieving the core sample, then lowering the overshot again—at the expense of drilling time. So, in deep holes (1000 metre plus holes are becoming increasingly common) the utilisation of the drilling rig actually spent drilling may only be around 30%.

This inefficiency has long been recognized within the industry, and numerous mechanisms have been developed to try and reduce non drilling time—such as rapid descent center tube assemblies which get to the bottom of the drill rods faster, improved drill bit designs to increase drilling speed, and vibrational assemblies which speed up the drilling process to try and increase the meters of core recovered in a drilling operation.

However, by far the biggest limiting factor in optimising drilling performance (meters of drill core recovered per shift) is the limited length of the inner tube. In fractured ground formations, it is common for the core sample to be pulled to surface with the inner tube less than 100% full of rock core. However, there are many instances where every core run has a 100% full inner tube, and the length of inner tube limits the efficiency of the drilling process. Providing for much longer drilling runs, for example increasing from 3 m to 6 m, or from 6 m to 9 m or 12 m plus, would achieve much greater drilling productivity and efficiency.

It is financially advantageous to the driller and the mine operator to be able to improve the drilling efficiency, to lower costs and increase profitability for all parties. However, drilling faster at the expense of poor core quality is not tolerable—retrieving quality core samples is the reason for drilling.

There are however a number of challenges around simply lengthening the inner tube to allow for longer core runs. A drill rig with a very long mast would allow for a longer inner tube. However, there are significant costs and transportation issues associated with a much longer mast, and often physical obstacles may limit this approach. Also, the physical handling of a long/heavy core sample at surface would provide significant health and safety challenges.

Core sample drilling is mostly in two sizes—H which recovers a 63 mm cylindrical rock core, and N which recovers a 47.6 mm cylindrical rock core. H core samples are significantly heavier than N samples. It is estimated that only approximately 15% of H core samples are drilled in 6-meter lengths (the rest are in 3-meter lengths) due to the weight and associated safety issues of manual handling 6 meter core samples at surface. With the N core samples being significantly lighter, it is estimated that 60% of samples are drilled using 6-meter inner tube lengths.

The reference to any prior art in the specification is not, and should not be taken as, an acknowledgement or any form of suggestion that the prior art forms part of the common general knowledge in any country.

SUMMARY

It is an object of the present invention to address any one or more of the above problems or to at least provide the industry with a useful choice.

According to a first aspect of the present invention there is provided a device for handling core samples during a core sample drilling operation, in use the core sample received in a string of inner tubes within a drill string, the device comprising:

a clamp configured to grip a lower inner tube below a joint between the lower inner tube and an adjacent upper inner tube of the string of inner tubes, with the lower inner tube received in the drill string and with the joint exposed above a top end of the drill string; and a coupling mechanism configured to engage the upper inner tube and/or the joint and operate to uncouple the upper inner tube from the lower inner tube.

In some embodiments, the lower inner tube received in the drill string and with the joint exposed above and adjacent to a top end of the drill string In some embodiments, the device comprises a positioning apparatus configured to move the clamp relative to the drill string to engage an upper end of the lower inner tube.

In some embodiments, the positioning apparatus comprises at least four degrees of freedom.

In some embodiments, the positioning device is configured to orient the clamp to position an inner tube carried by the clamp with a longitudinal axis of the tube coincident with a longitudinal axis of the drill string.

In some embodiments, the positioning device is configured to move the clamp in a direction lateral to the longitudinal axis of the drill string.

In some embodiments, the positioning apparatus is configured to orient the clamp by pivoting the clamp about two spaced apart parallel pivot axes, in use the pivot axes orthogonal to a longitudinal axis of the drill string.

In some embodiments, the positioning apparatus is a first positioning apparatus and the device comprises a second positioning apparatus configured to move the coupling mechanism relative to the drill string and clamp to engage the upper inner tube.

In some embodiments, the second positioning apparatus is carried by the first positioning apparatus.

In some embodiments, the second positioning apparatus comprises at least three degrees of freedom.

In some embodiments, the second positioning apparatus is configured to rotate the coupling mechanism about an axis parallel to the axis of the drill string.

In some embodiments, the second positioning apparatus is pivotally attached to the first positioning apparatus to pivotally couple the coupling mechanism to pivot relative to the clamp between a raised position and a lowered position, in the raised position the coupling mechanism is axially spaced from and aligned with the clamp so that an inner tube received in the coupling mechanism is aligned with an inner tube received in the clamp.

In some embodiments, the clamp and coupling mechanism both pivot in a plane.

In some embodiments, first positioning apparatus is configured to orient the clamp by pivoting the clamp about a first pivot axis and a second pivot axis parallel to the first pivot axis, and the second positioning apparatus pivotally couples the coupling mechanism to pivot relative to the clamp between the raised position and the lowered position about a third pivot axis parallel to the first and second pivot axes.

In some embodiments, the second positioning apparatus is configured to move the coupling mechanism along an axis of the drill string independently of the clamp.

In some embodiments, the second positioning apparatus is configured to move the coupling mechanism and/or an upper clamp configured to grip the upper inner tube along an axis of the drill string to separate the upper tube from the adjacent lower tube after the tubes are uncoupled to expose a portion of the core sample therebetween.

In some embodiments, the second positioning apparatus comprises a mast pivotally attached to the first positioning apparatus, and the coupling mechanism is mounted to move along the mast to move axially along the longitudinal axis of the drill string in use independently of the clamp.

In some embodiments, the first positioning apparatus is mounted to pivot about a pivot axis orthogonal to the first, second and third pivot axes to allow for the clamp and the mast carrying the coupling mechanism to cant either side of vertical.

In some embodiments, the second positioning apparatus is configured to move the coupling mechanism orthogonal to an axis of the drill string.

In some embodiments, the coupling mechanism is configured to rotate the upper inner tube to uncouple the upper inner tube from the adjacent lower inner tube.

In some embodiments, the coupling mechanism is configured to rotate the upper inner tube to couple the upper inner tube to the adjacent lower inner tube.

In some embodiments, the coupling mechanism comprises a pair of jaws moveable between an open position and a closed position, each jaw of the pair of jaws comprising at least one roller configured to rotate, and wherein in the closed position the rollers engage the upper tube and rotate to uncouple the upper tube from the adjacent lower inner tube.

In some embodiments, the device comprises a core support clamp, the core support clamp in fixed relation to the coupling mechanism and aligned with and axially spaced from the coupling mechanism to grip an exposed portion of the core when the upper and lower inner tubes have been uncoupled and separated.

In some embodiments, the device comprises a cutting or breaking mechanism, to cut or break an exposed portion of the core between the upper and lower inner tubes after the upper and lower inner tubes have been uncoupled and separated.

In some embodiments, the cutting or breaking mechanism comprises a blade or at least one chisel movable between a retracted position and an extended position to cut or break through the core sample.

In some embodiment, the cutting or breaking mechanism is configured to break or fracture the core to thereby provide a witness mark on the core or at the break or fracture to assist with identifying an orientation between adjacent core samples after cutting or breaking.

In some embodiments, the core support clamp comprises a pair of jaws configured to open and close to unclamp and clamp the core, and the breaking mechanism comprises at least one chisel mounted to one or both jaws, the chisel(s) projecting inwardly of the jaw(s) to extend into a surface of the core when the core clamp grips the core.

In some embodiments, the cutting or breaking mechanism is mounted below and in fixed relation to the coupling mechanism.

In some embodiments, the cutting or breaking mechanism is configured to remain in the extended position or move to an intermediate position to support a portion of the core sample above the cutting or breaking mechanism and retain the portion of the core sample in the uncoupled upper inner tube.

In some embodiments, the clamp is a lower clamp, and the device comprises an upper clamp to grip and/or support the upper inner tube.

In some embodiments, the device comprises a positioning apparatus to move the coupling mechanism and the upper clamp relative to the drill string to engage the upper inner tube.

In some embodiments, the coupling mechanism and the second clamp are axially spaced apart along an axis of the string of inner tubes.

In some embodiments, the inner tubes are coupled together by a threaded engagement.

In some embodiments, the device comprises a marking mechanism to provide a longitudinal mark to an exposed portion of the core between the upper and lower inner tubes after the upper and lower inner tubes have been uncoupled and separated, to preserve a known orientation of adjacent portions of the core after cutting or breaking.

In some embodiments, the marking mechanism is mounted below and in fixed relation to the coupling mechanism.

In some embodiments, the marking mechanism is located axially between the coupling mechanism and the breaking or cutting mechanism.

In some embodiments, the device comprises a cam clamp in fixed relation to the clamp and aligned with and axially spaced from the clamp, the positioning apparatus configured to move the clamp and the cam clamp together.

In some embodiments, the cam clamp comprises a pair of jaws configured to remain in contact with the inner tube and allow the inner tube to slip through the cam clamp when withdrawn from the drill string and cam towards a clamped position by friction contact between the inner tube and the jaws by relative movement of the inner tube into the drill string, and an actuator to move the jaws apart to an open position to allow the inner tube to be inserted into the drill string.

According to a second aspect of the present invention there is provided a method for drilling and recovering core samples from a formation, the method comprising:

i) providing a drill rig with a drill string for drilling into a formation to extract a core sample;

ii) advancing an inner tube into the drill string to be received therein with an upper end of the inner tube exposed above a top end of the drill string;

iii) coupling a next inner tube to the upper end of the inner tube received in the drill string to form a string of inner tubes comprising at least an uppermost inner tube and an adjacent second-uppermost inner tube;

iv) lowering the string of inner tubes to the bottom of the drill string;

v) drilling into the formation to a depth greater than the length of a single inner tube of the string of inner tubes and less than or equal to a length of the string of inner tubes to receive the core sample within the string of inner tubes;

vi) recovering the string of inner tubes with core sample received therein to expose a lower end of the uppermost inner tube and an upper end of the adjacent second uppermost inner tube coupled thereto above the top end of the drill string with the second upper most inner tube received in the drill string;

vii) uncoupling and separating the uppermost inner tube from the adjacent second uppermost inner tube to expose a portion of the core sample therebetween;

viii) cutting or breaking the core sample through the exposed portion of the core sample;

ix) removing the uppermost inner tube with a corresponding portion of the core sample therein from the drill rig;

x) recovering the second uppermost inner tube with a corresponding portion of the core sample therein from the drill string and removing from the drill rig.

In some embodiments, in step ii) the method comprises advancing an inner tube into the drill string to be received therein with an upper end of the inner tube exposed above and adjacent to a top end of the drill string.

In some embodiments, in step vi) the method comprises recovering the string of inner tubes with core sample received therein to expose a lower end of the uppermost inner tube and an upper end of the adjacent second uppermost inner tube coupled thereto above and adjacent to the top end of the drill string.

In some embodiments, the string of inner tubes comprises more than two inner tubes.

In some embodiments, in step iii) the method comprises:

iii) a) coupling the next inner tube to the exposed upper end of the inner tube received in the drill string;

iii) b) advancing the coupled inner tubes into the drill string to be received therein with an upper end of an uppermost inner tube exposed above the top end of the drill string;

iii) c) repeating steps iii) a) and iii) b) until a desired number of inner tubes are coupled together to form the string of inner tubes.

In some embodiments, in step x) the method comprises: repeating steps vi) to ix) until an upper end of a lowermost inner tube of the string of inner tubes is above the upper end of the drill string; and recovering the lower most inner tube with a corresponding portion of the core sample therein from the drill string and removing from the drill rig.

In some embodiments, the method comprises providing a clamp and in step ii) the method comprises clamping the upper end of the inner tube.

In some embodiments, the method comprises providing a coupling mechanism configured to uncouple the inner tubes and in step vii) the method comprises: clamping the upper end of the second upper most inner tube with the clamp, engaging the coupling mechanism with the uppermost inner tube, and operating the coupling mechanism to uncouple the uppermost inner tube from the second uppermost inner tube.

In some embodiments, in step vii) the method comprises: operating the coupling mechanism to rotate the uppermost inner tube to uncouple the uppermost inner tube from the adjacent second uppermost inner tube.

In some embodiments, the method comprises providing a coupling mechanism configured to couple the inner tubes and in step iii) the method comprises: clamping the upper end of the inner tube exposed above the upper end of the drill string with the clamp, engaging the coupling mechanism with the next inner tube, and operating the coupling mechanism to couple the next inner tube to the upper end of the inner tube received in the drill string.

In some embodiments, in step viii) the method comprises: moving the uncoupled uppermost inner tube along an axis of the drill string to expose the portion of the core sample.

In some embodiments, the method comprises providing a cutting or breaking mechanism and in step viii) the method comprises: operating the cutting or breaking mechanism to cut the exposed portion of the core.

In some embodiments, the cutting or breaking mechanism is configured to move between a retracted position and an extended position to cut or break the core, and in step viii) the method comprises: after cutting or breaking the core, operating the cutting or breaking mechanism to remain in the extended position or move to an intermediate position to support a portion of the core sample above the cutting or breaking mechanism and retain the portion of the core sample in the uncoupled uppermost inner tube.

In some embodiments, each inner tube comprises a thread at each end, and in step (iii) the method comprises coupling the next inner tube to the upper end of the inner tube received in the drill string by rotating and threading the next inner tube to the upper end of the inner tube received in the drill string, and in step (iv) the method comprises uncoupling the uppermost inner tube from the adjacent second uppermost inner tube by rotating and unthreading uppermost inner tube from the second uppermost inner tube.

In some embodiments, in step vii) the method comprises providing a longitudinal mark to the exposed portion of the core between the upper and lower inner tubes after the upper and lower inner tubes have been uncoupled and after or during separating the uppermost inner tube from the adjacent second uppermost inner tube.

In the second aspect, the method may comprise providing a device as described above in relation to the first aspect of the invention, and the method may comprise operating one or more features of the device to carry out the steps of the method.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

Figure 10:
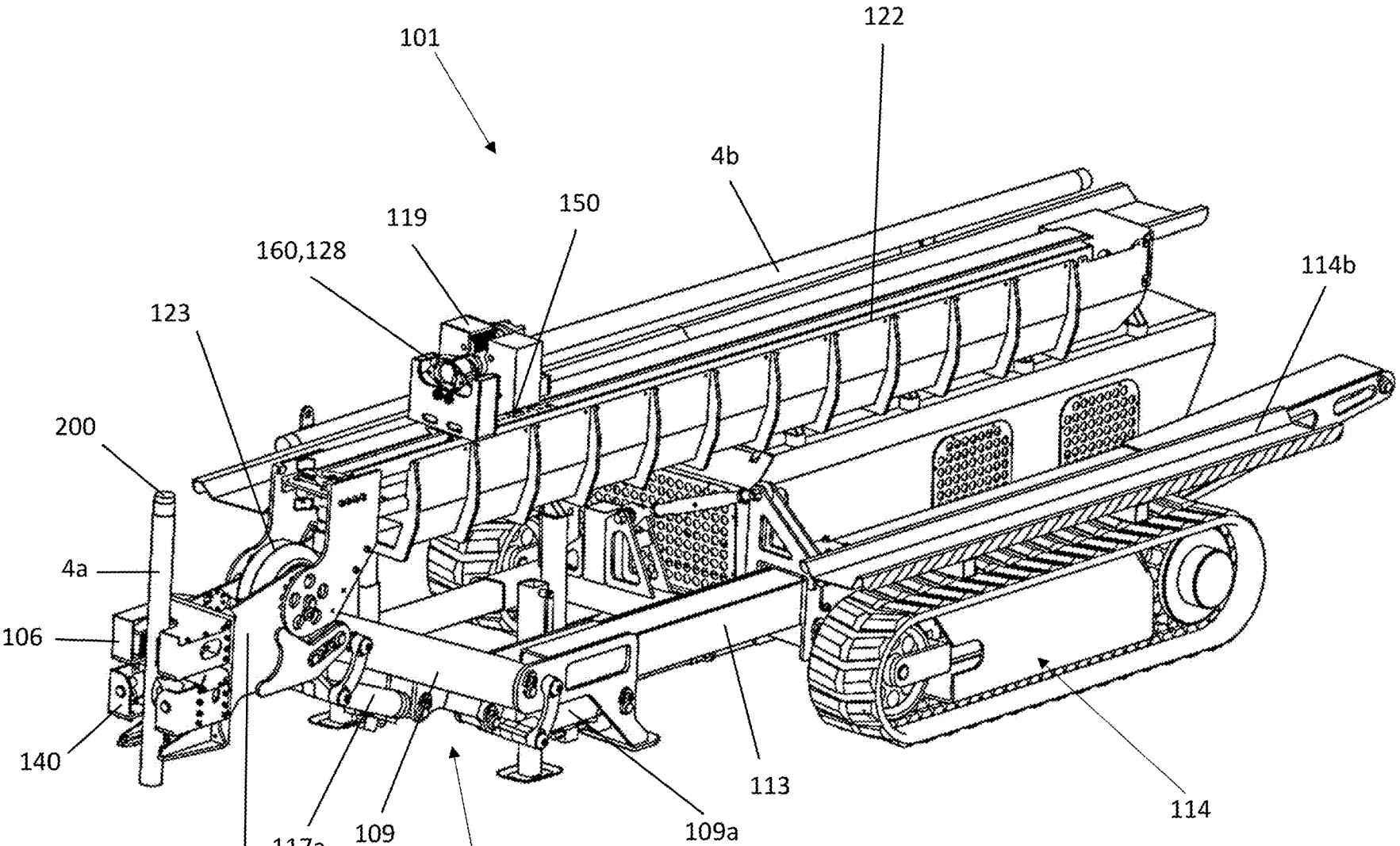
FIG. 10 illustrates the device of FIG. 9 with the mast in a lowered position to present an inner tube for unloading.
Figure 11:
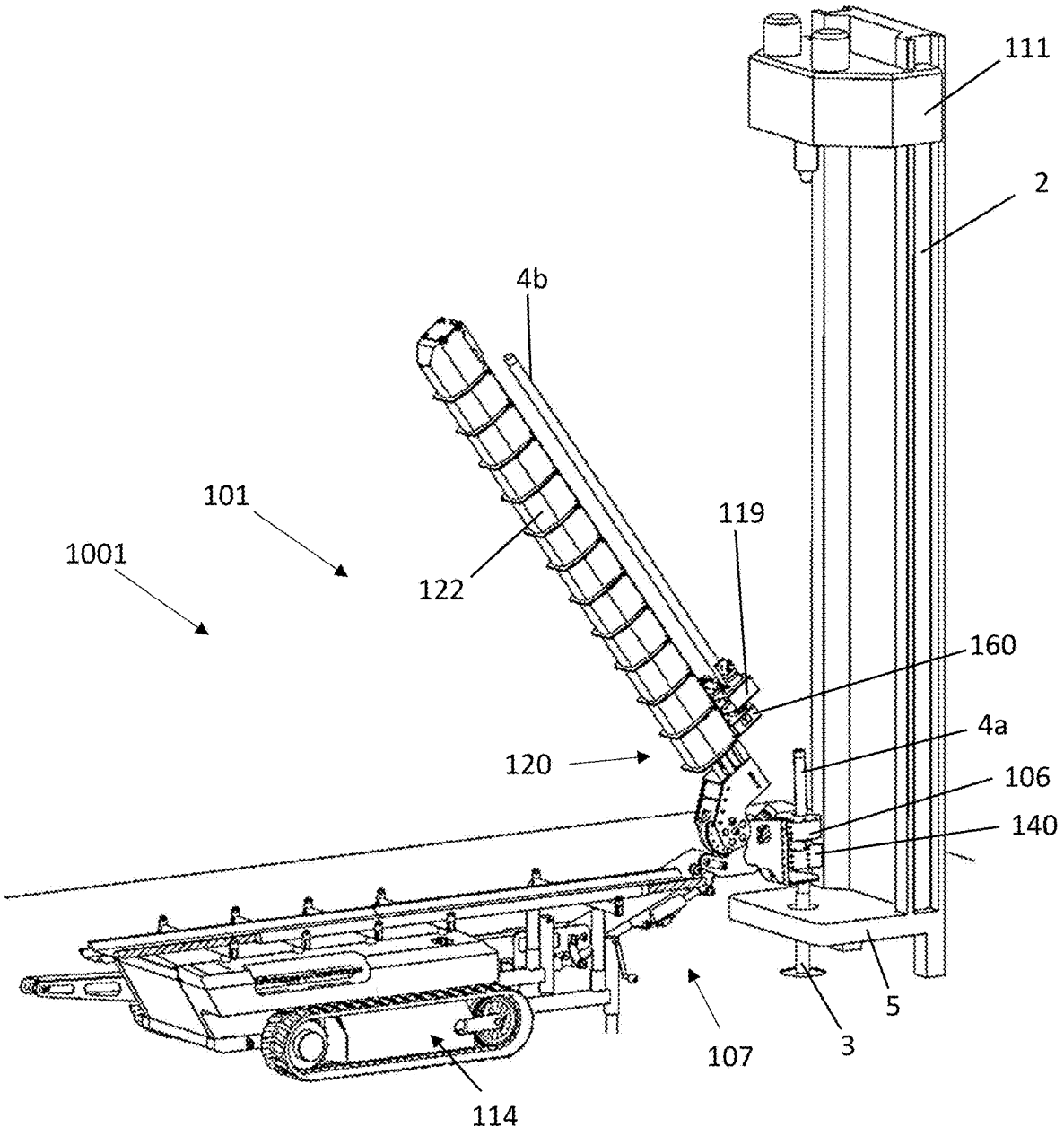
FIG. 11 illustrates the device of FIG. 9 together with a drill rig, and with the mast in an intermediate position and the device clamped to an inner tube received in a drill string.

It should be noted that FIGS. 9, 10, 13, 14, 19, 20, 24, 25 omit a drill string 3 appearing in FIG. 11. A portion of an inner tube or inner tube string appearing above the drill string is shown in these Figures.

DETAILED DESCRIPTION

Figure 1:
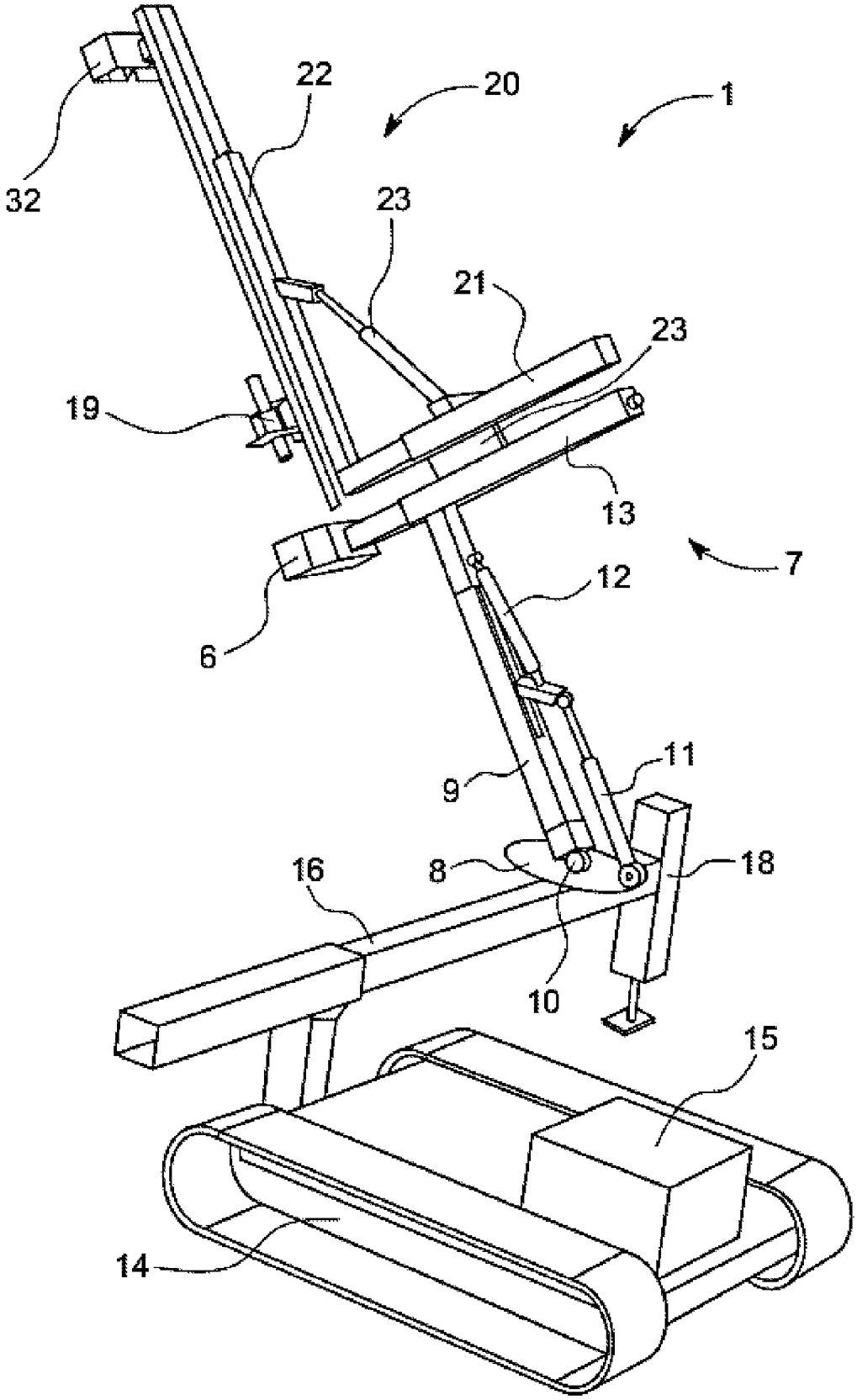
FIG. 1 illustrates an example core sample handling device according to one aspect of the present invention.
Figure 2:
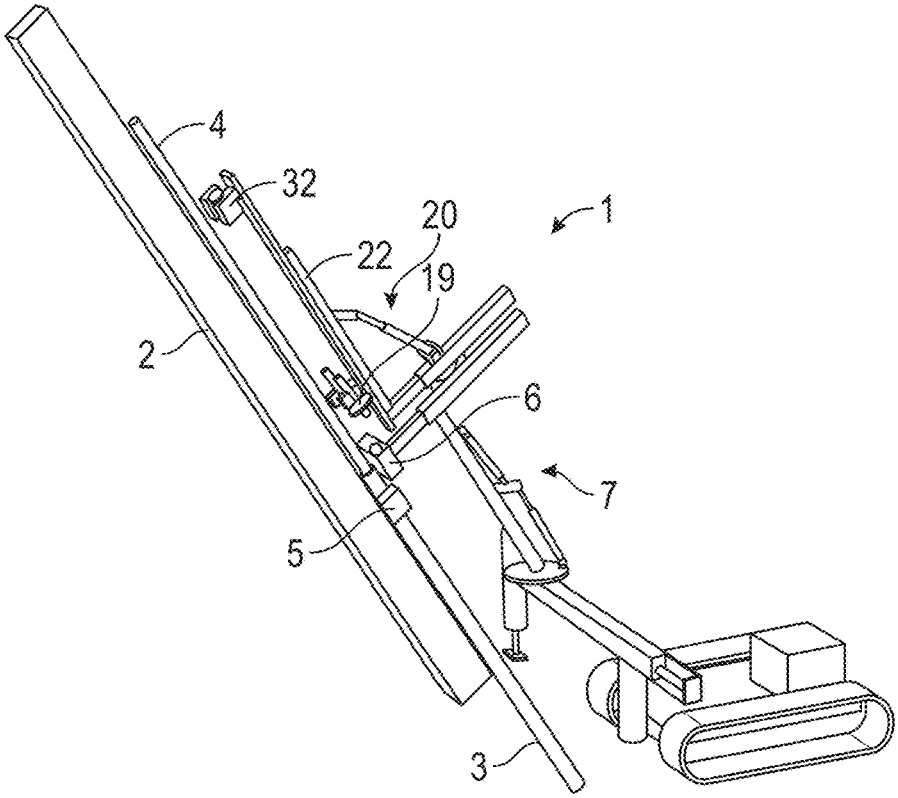
FIG. 2 illustrates the device of FIG. 1 positioned adjacent a drill mast of a drill rig carrying a drill string and with an inner tube extending from the drill string.
Figure 2A:
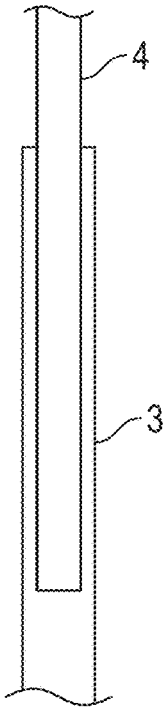
FIG. 2A illustrates an enlarged fragmentary side view of the tubing illustrated in FIG. 2.
Figure 3:
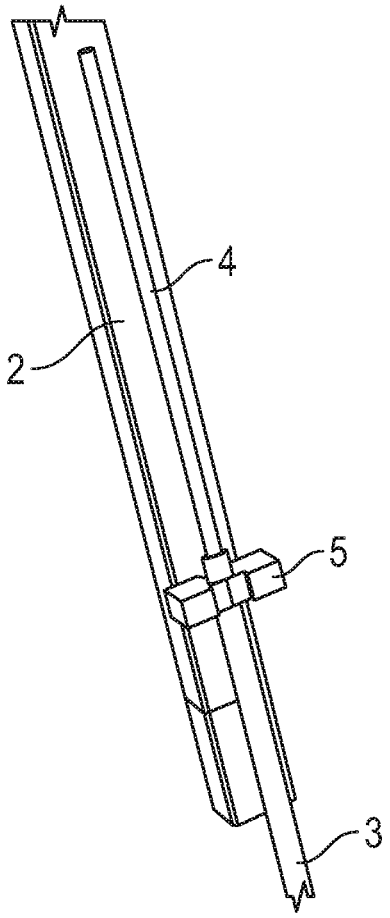
FIG. 3 illustrates the drill mast appearing in FIG. 2 carrying a drill string and with an inner tube extending from the drill string.

FIG. 1 illustrates a core sample handling device for use together with a drilling rig (not shown) for drilling and recovering core samples from a formation. FIG. 2 shows the device 1 alongside a drilling rig mast 2 of a drilling rig. FIG. 2A shows an enlarged view of a drill string 3 of FIG. 2. The drill mast is also shown in FIG. 3. The drilling rig mast 2 handles the drill string 3 comprising drill rods (or drill pipe) coupled together to form the drill string 3 as known in the art. The drilling rig rotates the drill string 3 with a hollow drill bit (not shown) at the bottom end to drill the core sample from the formation. An inner tube 4 to be received inside the hollow drill string 3 is also illustrated in FIGS. 2 and 2A. In use the inner tube 4 is inserted down the inside of the drill string 3 to locate just above the drill bit at a bottom end of the drill string 3 to receive the core sample during a drilling operation.

During a core sample drilling operation, the drill rig advances the drill string 3 into the formation. In an initial drilling step, the drill string 3 is advanced to a depth equal to (or less than) the length of the inner tube 4 received in and located at the bottom of the drill string 3. The drilling operation then ceases, and the stationary drill string 3 remains in the formation and may be clamped by a drill rig foot clamp 5. The inner tube 4 with core sample received therein is recovered from the drill string 3 to the surface, e.g. by wireline in the known way. The core sample is removed from the inner tube 4, e.g. by water pressure or manual shaking, and the inner tube 4 is again provided into the drill string 3. The drill cycle of drilling to a depth of the inner tube length, recovering the inner tube with core sample, removing the core sample and returning the empty inner tube to the drill string is repeated, and may be repeated several times or many times until the drilling and core recovery has reached the desired depth.

Once the drill string 3 has been advanced into the ground to a predetermined depth, the present invention provides for a plurality of inner tubes 4 to be coupled together, to form a string of inner tubes of a desired length, and to advance the string of inner tubes into the drill string. The length of the string of inner tubes 4 allows for an extended length core sample to be drilled and recovered which is longer than the length of a single inner tube 4, in a single drilling cycle.

The device 1 therefore allows for an increased drilling time compared to prior art drilling operations operating with a single inner tube 4, since the drill rig may drill continuously to a depth up to the entire length of the string of inner tubes. It is not necessary to stop drilling and recover a core sample to the surface each time the drilling rig drills a distance equal to the length of a single inner tube. The frequency at which the rig must stop drilling to recover a core sample to the surface is therefore reduced, increasing the utilisation of the drilling rig with a corresponding improve in drilling efficiency.

Referring again to FIG. 1, 2, 5 the core sample handling device 1 comprises a clamp 6. At the beginning of a drilling cycle, an inner tube 4 is lowered into the drill string 3, for example by a conventional wireline system comprising a wireline winch, wireline and housing plug or overshot (not shown), until a top end of the inner tube 4 is adjacent to and exposed above an upper end of the drill string 3. The clamp 6 is configured to grip or clamp the exposed upper end of the inner tube 4 received in the drill string. The clamp 6 comprises a pair of jaws (6*a*, 6*b* shown in FIGS. 7 and 8) configured to open and close, much like the drill rig foot clamp 5. The jaws may be operated between clamped and unclamped positions by hydraulic actuators (not shown) or the like. The illustrated configuration, the jaws move in a direction orthogonal to the longitudinal axis to move between the open and close positions. In the open position the jaws present a mouth or lateral opening to receive a portion of the inner tube into the clamp.

The clamp 6 is supported by a positioning mechanism 7. The positioning mechanism 7 is configured to move the clamp 6 relative to the drill mast 2 and drill string 3, to position the clamp 6 about the inner tube 4 to clamp and unclamp the inner tube 4. In the illustrated embodiment, the positioning mechanism 7 comprises arms or links coupled together to support the clamp and move the clamp relative to the drill rig and drill string. The positioning mechanism 7 may provide at least three degrees of freedom, or at least four degrees of freedom, for movement of the clamp in a 3-dimensional space and pivot to align the clamp with a longitudinal axis of the drill string. In the illustrated embodiment, the positioning apparatus comprises a rotational member 8, i.e. a 'turn table' to rotate the clamp 6 about a vertical axis, and an arm 9 pivotally coupled to the turn table 8 to pivot at a pivot joint 10 about a horizontal axis. Rotation of the turn table 8 is preferably actuated by an actuator (not shown) or may be manually rotated. The arm 9 pivots about a horizontal axis by actuation of an actuator 11. The arm 9 is a telescopic arm, to extend and retract to move the clamp 6 in a vertical direction (or a direction with a substantial vertical component depending on the orientation of the arm 9). The arm 9 is actuated to move the clamp 6 in a longitudinal direction of the drill string 3. The arm 9 is extended and retracted by actuation of an actuator 12. A second arm 13 is attached between the clamp 6 and the first arm 9. The second arm 13 is a telescopic arm, to extend and retract to move the clamp 6 in a horizontal direction (a direction with a substantial horizontal component depending on the orientation of the arm 9). The second arm is actuated to move the clamp 6 in a lateral direction of the drill string 3. The second arm is extended and retracted by actuation of an actuator (not shown). The second arm 13 is orthogonal to the first arm 9.

Thus, the illustrated positioning apparatus is configured to provide four degrees of freedom, to align the clamp with the drill string and position the clamp about the inner tube received in the drill string. Additional degrees of freedom may be provided, for example to align with a drill string at an angle to two orthogonal vertical planes. For example, the pivot joint between the turn table and the first arm, or the pivot joint and the turntable, may be replaced with a ball and socket or universal joint. The illustrated positioning apparatus is provided by way of example only. Any other positioning apparatus may be provided to support and move the clamp with at least four degrees of freedom.

In the illustrated embodiment, the positioning apparatus 7 is supported by a vehicle 14. The vehicle 14 is configured to move the device 1 over a rig or ground surface, relative to a drilling rig or drilling rig mast 2. In the illustrated embodiment, the vehicle 14 comprises tracks that are driven and supported by rollers (not shown). The vehicle comprises an engine 15 for driving the tracks and or hydraulic pump(s), or some other means of propulsion—or it may be powered from the drill rig. The illustrated embodiment further comprises a telescoping beam 16 between the vehicle 14 and the positioning apparatus 7, to provide further adjustment of the position of the clamp 6 with respect to the drill string 3 in a horizontal direction. The beam 16 is supported by a post extending from the vehicle 14, and a stabilising leg spaced 18 from the post. The stabilising leg may be height adjustable to support the beam 16 from a ground surface or rig surface. In some embodiments the device 1 may be without the vehicle 14 and/or without the beam 16. For example, the device 1 may be integrated together with a drill rig, in which case the vehicle and/or beam may not be required.

Figure 6:
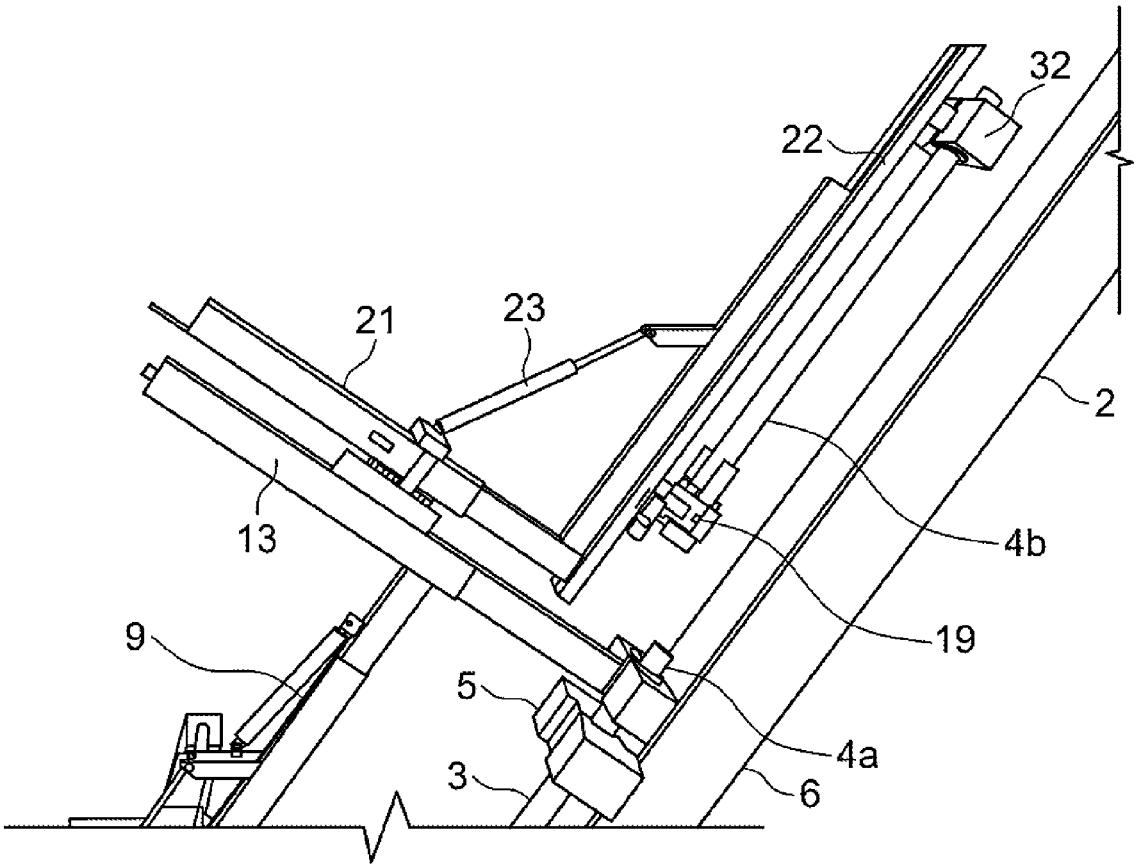
FIG. 6 illustrates the device of FIG. 1 with a lower clamp of the device gripping an upper end of an inner tube exposed from a top end of a drill string supported by a drill mast, and an upper inner tube carried by a coupling mechanism and upper clamp of the device.

With an inner tube 4 received in the drill string 3 with an upper end clamped in clamp 6, another inner tube 4 may be loaded above the drill string 3 and coupled with the exposed end of the inner tube received in the drill string 3. For example, the next inner tube 4 may be lifted into place above the drill string 3 by the wireline system. An operator may connect the next inner tube to the adjacent lower tube already received in the drill string. Alternatively, a coupling mechanism of the device (described below) may be used to couple the two inner tubes together. For example, the next inner tube may be loaded (e.g. by wireline) into the coupling mechanism (for example as shown in FIG. 6 and then the coupling mechanism may be actuated to clamp the inner tube and then moved to align the next inner tube with the inner tube already received in the drill string, to then be coupled together.

Once the inner tubes are coupled together, the clamp 6 releases the exposed top of the inner tube received in the drill string, and the coupled inner tubes may be lowered into the drill string 3. A drilling operation may require a string of inner tubes comprising only two inner tubes. In which case the two coupled inner tubes form a string of inner tubes (or an inner tube string). The string of inner tubes is lowered to the bottom of the drill string 3 to allow for drilling to recommence. Where more than two inner tubes 4 are required, the clamp 6 is released, and the coupled tubes are lowered until the top of the upper most tube is adjacent the top of the drill string 3. The clamp 6 is operated to clamp the exposed upper end of the uppermost tube 4 received in the drill string 3. The next inner tube is loaded and coupled to the string of inner tubes. The process of loading, coupling together and inserting inner tubes int the drill string is repeated until a desired length of inner tube string is achieved. The string of inner tubes is then lowered to the bottom of the drill string to allow a further drilling cycle to be carried out.

Figure 4:
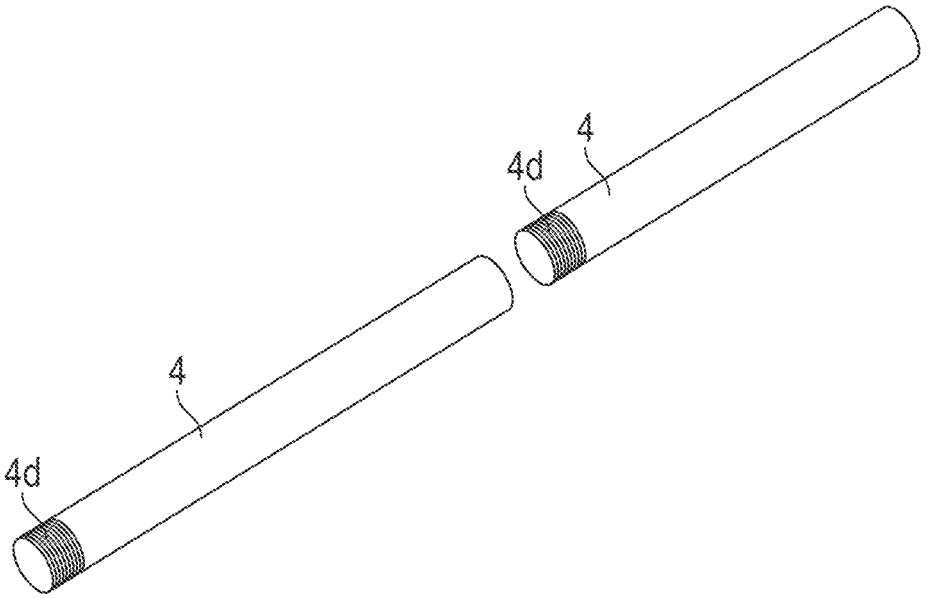
FIG. 4 illustrates two inner tubes with threaded ends to form a threaded connection or joint between the tubes when coupled together.

Adjacent inner tubes 4 are coupled together by a joint. In a preferred embodiment the joint is a threaded joint. As shown in FIG. 4 preferably each inner tube 4 comprises a thread 4*d* at each end, to engage a corresponding thread at the end of an adjacent inner tube. For example, each inner tube has a female thread at one end and a male thread at an opposite end. Mating female and male threads form the joint between adjacent inner tubes. To couple and uncouple two inner tubes, the clamp grips a lower one of the two tubes 4, and the upper one of the two tubes is rotated to thread together or unthread and separate the tubes. An alternative joint is a threaded coupling, e.g. a threaded union comprising a thread at each end that an inner tube is threaded to. It should be recognised that other joints between inner tubes could be used—such as a bayonet connection or similar.

Figure 5:
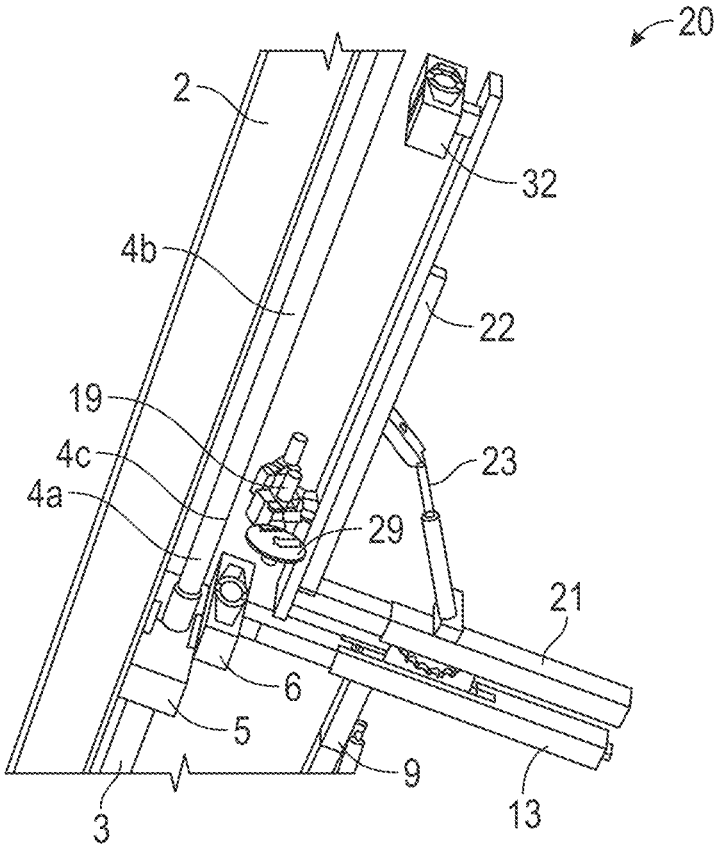
FIG. 5 Illustrates a portion of the device of FIG. 1 alongside a drill mast with a clamp and a coupling mechanism facing a drill string and inner tube supported by the drill mast.

The device comprises a coupling mechanism 19. With reference to FIG. 5, the coupling mechanism 19 is configured to engage an upper tube 4*b* or a joint between the upper tube 4*b* and an adjacent lower tube 4*a*, with the lower tube 4*a* held by the clamp 6. The coupling mechanism 19 is operable to uncouple the upper tube 4*b* from the adjacent lower tube 4*a*. For example, the coupling mechanism 19 is operable to rotate the upper tube 4*b*, to uncouple the upper tube 4*b* from the adjacent lower tube 4*a*. In some embodiments, the coupling mechanism 19 is also configured to couple two inner tubes 4*a*, 4*b* together. For example, the coupling mechanism 19 may be configured to engage and rotate the upper tube in a first rotational direction to uncouple the tubes and engage and rotate the upper tube in a second opposite rotational direction to couple the tubes together. The coupling mechanism thus may be referred to as a tube uncoupling mechanism, a tube coupling and uncoupling mechanism, a tube make or break mechanism etc.

The coupling mechanism 19 is supported by a positioning apparatus 7, 20, to move the coupling mechanism 19 relative to the drill mast and drill string 3 and position the coupling mechanism 19 about the inner tube 4*b* to engage the inner tube 4*b* to uncouple (or couple) the inner tube 4*b* from (or to) an adjacent lower tube 4*a*. In the illustrated embodiment, the positioning apparatus 7, 20 comprises the positioning apparatus 7 (the first positioning apparatus) and a second positioning apparatus 20. The second positioning apparatus 20 is coupled to the first positioning apparatus 7. The first positioning apparatus 7 is configured to move the clamp 6 and the coupling mechanism 19 relative to the drill string 3, to position the clamp 6 to grip the lower inner tube 4*a* below the joint 4*c* with the adjacent upper inner tube 4*b* and position the coupling mechanism 19 to engage the upper inner tube 4*b* or the joint 4*c*.

The second positioning mechanism 20 is configured to move the coupling mechanism 19 relative to the clamp 6, to engage the upper inner tube 4*b*. The second positioning mechanism 20 comprises an arm 21. The arm 21 is a telescopic arm, to extend and retract to move the coupling mechanism in a horizontal direction (a direction with a substantial horizontal component). The arm 21 is actuated to move the coupling mechanism 19 in a lateral direction of the drill string 3. The arm 21 is extended and retracted by actuation of an actuator (not shown). The coupling mechanism 19 is mounted on a mast 22 attached to the arm 21. The coupling mechanism is mounted to move axially along the mast 22 to move independently of the clamp 106. For example, the mast may be extendable to move the coupling mechanism 19 axially and in a longitudinal direction of the drill string 3. The mast 22 is actuated by actuator 23. The second positioning mechanism 20 further comprises a turn table or rotary actuator 23 to mount the second positioning apparatus 20 to the first positioning apparatus 7. Thus, the second positioning apparatus 20 provides three degrees of freedom, to move the coupling mechanism 19 longitudinally and laterally with respect to the drill string 3 and the clamp 6, and to rotate the coupling mechanism 19 away from the drill string. This also allows the uncoupled inner tube with the entrained core sample to be rotated away from the drill rig to allow for a safe presentation of the inner tube to the drill crew for unloading.

Figure 7:
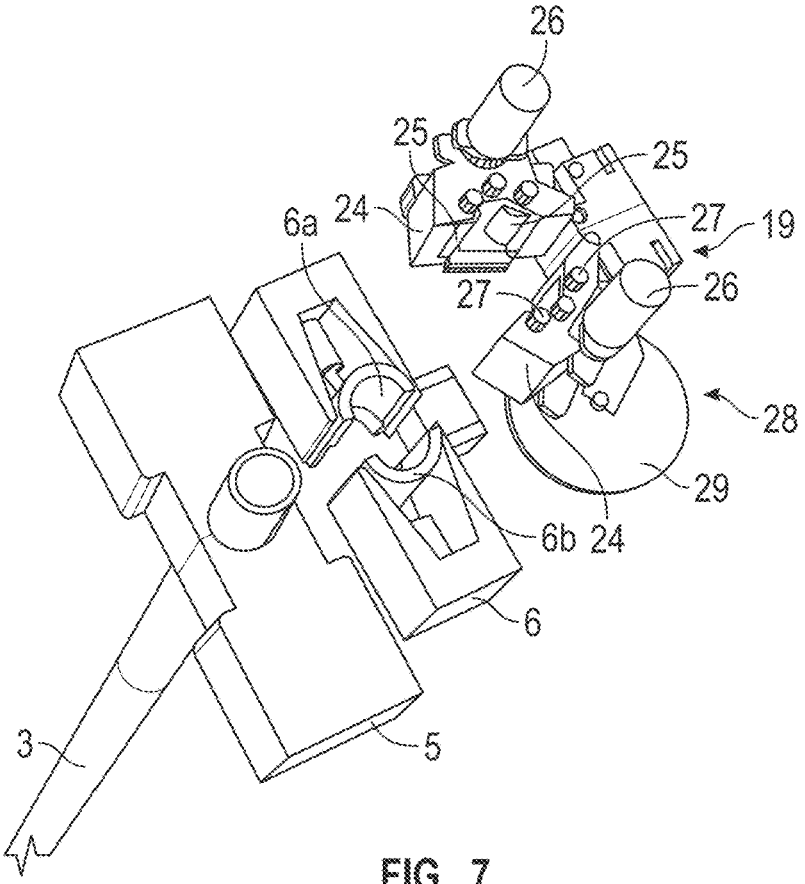
FIG. 7 illustrates the lower clamp and the coupling mechanism facing a longitudinal axis of the drill string with the clamp and coupling mechanism in open positions.
Figure 8:
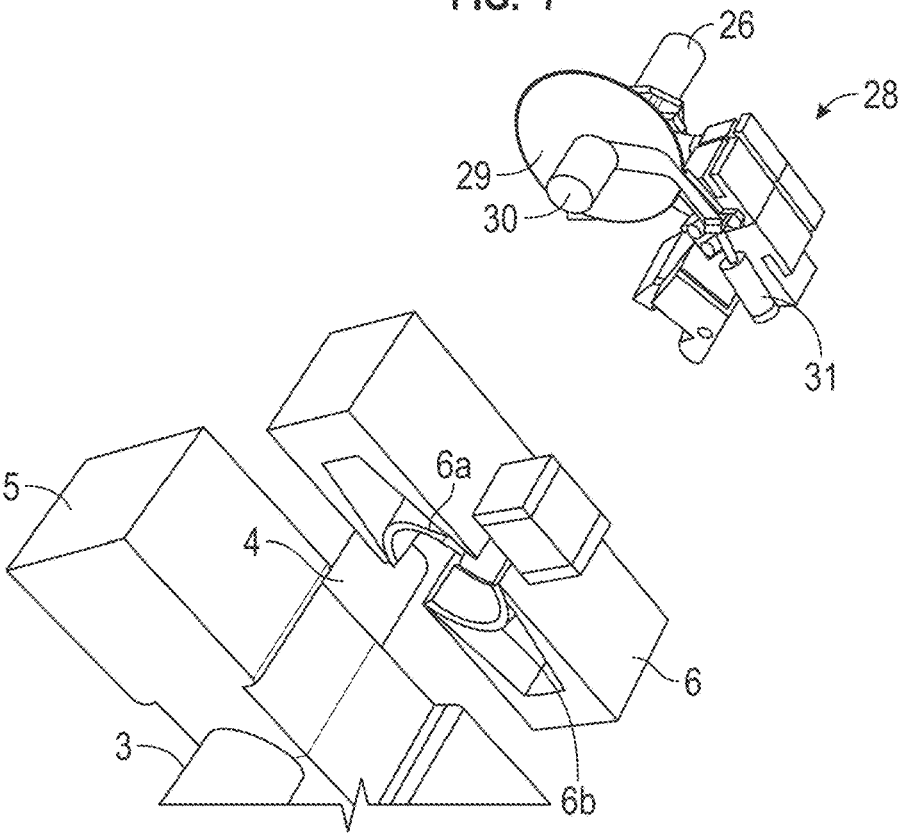
FIG. 8 is another view of the lower clamp and the coupling mechanism facing a longitudinal axis of the drill string with the clamp and coupling mechanism in open positions.
Figure 9:
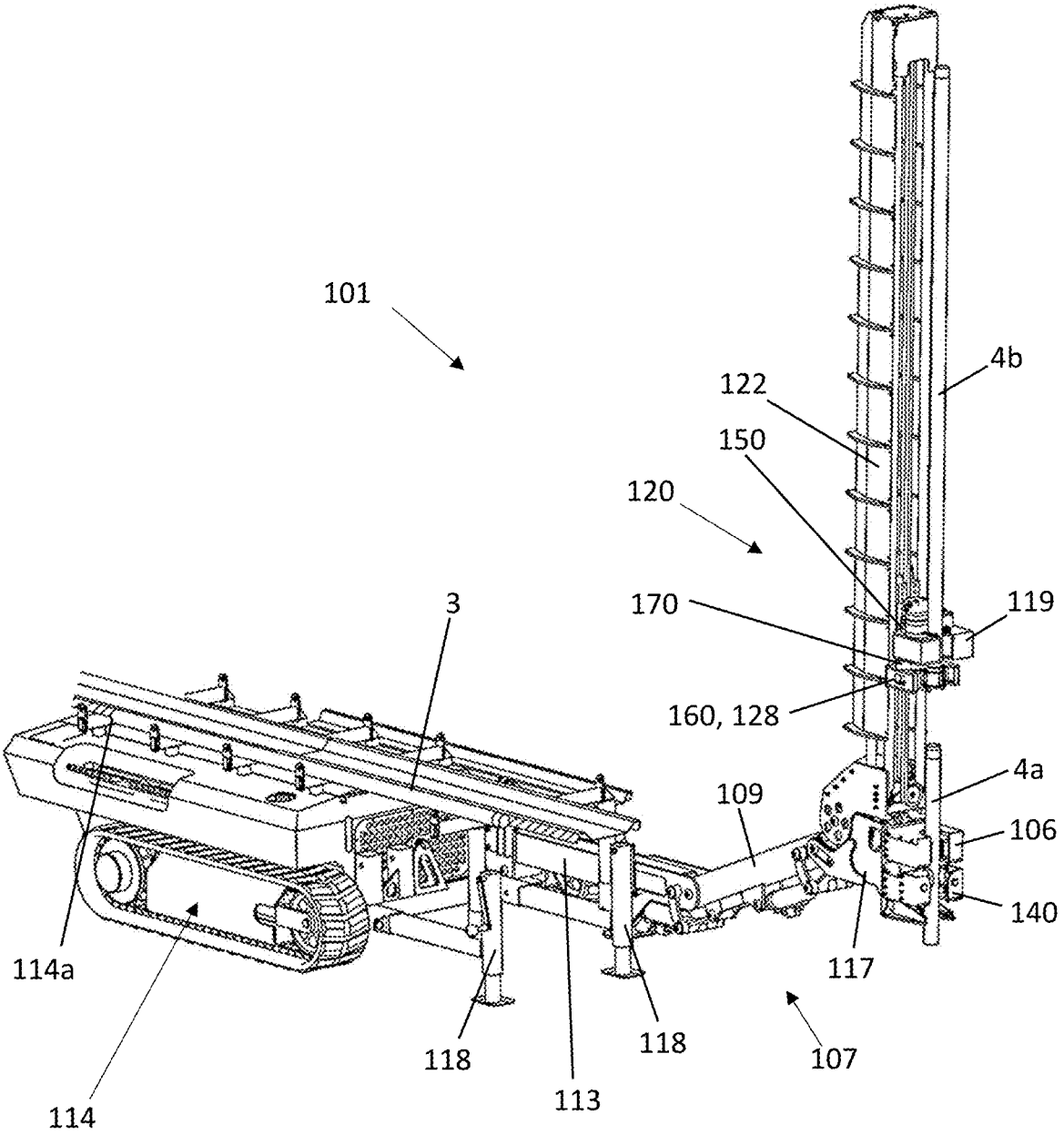
FIG. 9 illustrates another example core sample handling device according to one aspect of the present invention with a mast of the device in a raised position and with an inner tube held by the device aligned with a longitudinal axis of the drill string.

With reference to FIGS. 7 and 8, the coupling device 19 comprises a pair of jaws 24 configured to open and close. The jaws 24 may be operated between open and closed positions by hydraulic actuators (not shown). With the inner tube located in the jaws, the coupling device is operated to close the jaws on the inner tube, i.e. just above the joint between the engaged inner tube and an adjacent lower inner tube. Each jaw comprises a roller, or pair of rollers 25. With the jaws closed, the roller or pair of rollers engage the inner tube. The rollers may be knurled or otherwise formed to grip the surface of the inner tube. One or more drive mechanisms (e.g. as motor) 26 drives one or both rollers 25 to rotate, to rotate the inner tube 4 to thereby uncouple (or couple) the inner tube 4*b* from the adjacent lower inner tube 4*a*. In the illustrated embodiment, the coupling mechanism comprises a drive mechanism associated with each jaw, to rotate the roller(s) of the respective jaw. Each roller may be coupled to the drive mechanism (e.g. a motor) via a chain or belt drive (not shown) and one or more sprockets or pulleys 27. However, the roller of one jaw may be rotated only, with the other roller being undriven or freewheeling.

The illustrated embodiment further comprises a cutting mechanism 28 configured to cut through an exposed portion of the core sample when recovering the core sample, as described below. In the illustrated embodiment, the cutting mechanism 28 is mounted to, or adjacent to, the coupling mechanism 19. The cutting mechanism 28 comprises a blade 29 located adjacent and below the coupling mechanism, i.e. below the jaws of the coupling mechanism. The blade is operable to cut through the core. The blade may be a circular blade and the cutting mechanism 28 comprises a drive mechanism (a motor) 30 to rotate the blade to cut the core. The blade 29 is moveable between an extended position and a retracted position. As shown in FIG. 8, an actuator 31 may actuate the blade between the extended position and the retracted position. The Figures show the blade in the retracted position only.

In the illustrated embodiment, the device 1 also comprises an upper clamp or upper support 32. The upper clamp or support 32 may comprise two jaws, as described above for the lower or bottom clamp 6. The upper clamp/support 32 is mounted to the mast 22. The upper clamp 32 is in a fixed relation to the coupling mechanism 19 and assists with securing an inner tube 4 and core sample therein when removing the inner tube and core sample from the rig. The upper clamp or support 32 may support the inner tube without gripping the inner tube. For example, the upper support may encircle the inner tube without gripping the inner tube.

Various operations of the device may be controlled remotely by an operator, for example via a control panel or computer, radio link etc. The device may comprise a programmable logic controller configured to control or actuate various operations of the device via operator inputs provided via the control panel. A power unit may be provided to power various actuators and/or motors of the device. For example, the power unit may provide electrical and/or hydraulic power to actuators and/or motors. The PLC may operate hydraulic control valves and/or electrical relays/switches and the like to energise actuators and/or motors of the device. Such control systems comprising a control panel or user interface, computing device such as a PLC, and associated equipment such as control valves, relays and switches are well known in the art. A person skilled in the art will appreciate that the device may comprise or be operated by such a control system.

A method for drilling and recovering core samples from a formation is now described. As mentioned above, an inner tube 4 is lowered into the drill string 3, for example by a conventional wireline system comprising a wireline winch, wireline and housing plug or overshot, until a top end of the inner tube is adjacent to and exposed above an upper end of the drill string 3. The positioning mechanism 7 is manipulated to move the (lower) clamp 6 to align with the upper end of the inner tube (4*a* in FIG. 6), and the clamp 6 is actuated to clamp or grip the upper end of the inner tube to hold the inner tube relative to the drill string, as illustrated in FIG. 6. The next inner tube 4*b* is then loaded above the drill string 3 and coupled to the exposed end of the inner tube 4*a* received in the drill string 3. The coupling of the two inner tubes 4*a*, 4*b* may be done manually by an operator or the coupling mechanism 19 may be moved to engage the upper tube 4*b* and rotate the upper tube 4*b* to couple the upper tube 4*b* to the adjacent lower tube 4*a*. When loading the inner tubes above the drill string the second positioning member 20 carrying the coupling mechanism 6 and upper clamp 32 may be rotated away from the longitudinal axis of the drill string.

Once the inner tubes 4*a*, 4*b* are coupled together, the clamp 6 releases the exposed top of the inner tube received in the drill string, and the coupled inner tubes are be lowered into the drill string 3, for example by wireline. A drilling operation may require a string of inner tubes comprising two inner tubes only. In which case the inner tube string comprising two coupled inner tubes may be lowered to the bottom of the drill string to allow a drilling operation to recommence. Where more than two inner tubes are required, the clamp 6 is released, and the coupled tubes are lowered until the top of the upper most tube 4*b* is adjacent the top of the drill string 3. The clamp 6 is operated to clamp the exposed upper end of the uppermost tube 4*b* received in the drill string 3, to allow the next inner tube to be loaded and coupled to the string of inner tubes. The process of loading and coupling inner tubes together is repeated until a desired length of inner tube string is achieved.

Once the string of inner tubes is complete, the clamp 6 is released from the tube string 4*a*, 4*b* and the string of inner tubes is then lowered to the bottom of the drill string to allow a further drilling cycle to continue. The positioning apparatus 7, 20 may be manipulated to move the clamp 6 and coupling mechanism 19 away from the drill string axis during drilling, to allow additional drill rods to be added to the drill string in the usual way. The drill string 3 is advanced into the formation for a distance greater than the length of a single inner tube, up to a distance equal to the length of the string of inner tubes. The drilling depth in a single drilling cycle may therefore be two or more times the length of a single inner tube. For example, where the inner tube string includes four 3-meter inner tubes, the drill string may be advanced 12-meters into the formation in a single drilling cycle.

Once the drill string 3 has been advanced for a desired distance, drilling ceases and the inner tube string 4*a*, 4*b* and core sample contained therein is recovered to the surface via a wireline until an upper most joint of the inner tube string is exposed above the top end of the drill string 3, i.e. to expose a lower end of an upper most inner tube and an upper end of an adjacent second upper most inner tube coupled thereto.

The positioning mechanism 7 is manipulated to move the (lower) clamp 6 to align with the upper end of the second upper most inner tube, and the clamp is actuated to clamp or grip the upper end of the second uppermost inner tube. The second positioning apparatus 20 is manipulated to move the coupling mechanism 19 (and upper clamp 32 if provided) to align with the string of inner tubes, i.e. the longitudinal axis of the drill string or string of inner tubes. The coupling mechanism 19 is then actuated to uncouple the uppermost tube from the adjacent second upper most tube. The upper tube clamp or support, where provided, may also be actuated to clamp or support the uncoupled inner tube.

Once the upper most tube is uncoupled, the mast of the device is actuated to move the upper most tube upwards along the longitudinal axis of the drill string, to separate the upper most tube from the adjacent second upper most tube to expose a portion of the core sample between the upper most and second upper most tubes. By example, the upper inner tube may be raised by 50 mm to 150 mm to expose a 50 mm to 150 mm length of the core sample. A longitudinal mark may be made to the exposed portion of the core, to preserve the known orientation of adjacent portions of the core after cutting. The cutting mechanism 28 is then operated to cut the core sample through the exposed portion of the core sample. The cutting mechanism blade 29 may remain in an extended position or return to an intermediate position after cutting through the core, to capture and securely hold the cut portion of the core sample above the blade 29 within the upper most tube. Additionally, or alternatively, the device may comprise a gripping device configured to grip the exposed portion of the core to ensure the core remains within the uncoupled upper tube.

The second positioning device 20 is then manipulated to move the separated inner tube and corresponding portion of core sample away from the drill string axis. For example, arm 21 is actuated to move the inner tube laterally away from the axis of the drill string (e.g. the position shown in FIG. 6) and/or the turn table 23 is actuated to rotate the inner tube away from the drill string axis, e.g. rotated 90 degrees away from the drill string axis. The second positioning apparatus is then manipulated to lower the inner tube with corresponding portion of core sample to a comfortable working height for an operator to safely handle the inner tube with core. The operator removes the core from the inner tube and stores the inner tube for a subsequent drilling cycle.

The operation of lifting the remaining string of inner tubes to expose the upper most joint above the drill string 3, uncoupling and separating the upper most inner tube, marking and cutting the exposed portion of core sample, and removing the upper most inner tube with corresponding portion of core sample from the rig is repeated until a single lower most inner tube is left in the drill string. The last inner tube with corresponding portion of core sample is lifted from the drill string, for example by the wireline system, and removed from the drill rig, to complete the drilling cycle. A new cycle can then be commencing, by stringing together inner tubes and lowering the string to the bottom of the drill string as described above.

Another core sampling handing device 101 according to an embodiment of the present invention is now described with reference to FIGS. 9 to 26. Similar features described above with reference to FIGS. 1 to 8 are identified by the same reference numerals but with 100 added.

The device 101 comprises a self-powered tracked vehicle 114. The vehicle 114 is configured to move the device 101 over a drill rig 1001 or ground surface, relative to the drilling rig 1001 or drilling rig mast 2. The vehicle provides a platform, deck or support 114*a* for receiving and/or storing lengths of drill rods 3. The vehicle also includes a platform, deck or support 114*b* for receiving and/or storing lengths of inner tubes 4. The vehicle may include one or more stabilising legs or posts 118.

The vehicle carries the lower or bottom clamp 106 for gripping the second upper most inner tube 4*a*. The clamp comprises a pair of jaws 106*a*, 106*b* configured to open and close. In the open configuration the jaws present a laterally facing mouth or opening to receive a portion of the inner tube laterally into the clamp, i.e. orthogonal to the longitudinal axis of the inner tube, to be clamped or gripped between the jaws when the jaws are in the close configuration. The jaws are operated between the close/clamped and open/unclamped positions by hydraulic actuators (not shown) or the like. Each jaw pivots to open and close about a pivot axis parallel to the longitudinal axis of the inner tube when received in the clamp 106. Alternatively, the clamp may have jaws configured to move/slide in a direction orthogonal to the longitudinal axis of the inner tube to move between the open and close positions. The clamp 106 is moveably supported from the vehicle 114 by a positioning apparatus 107. Primary positioning of the clamp 106 relative to the drill rig and drill string 3 may be accomplished by moving the vehicle 114 over the ground or rig surface, and then secondary or finer positioning of the clamp 106 relative to the drill rig and drill string 3 may be accomplished by movement of the positioning apparatus 107.

In this embodiment, the positioning apparatus 107 comprises an arm 113 actuated by an actuator (hidden from view in the Figures) to move the clamp 106 in a direction lateral to the drill rig mast 2 or longitudinal axis of the drill string 3. For example, when the vehicle is horizontal the arm 113 moves in a horizontal direction. The arm is configured to extend from and retract to the vehicle, for example by telescoping. The positioning apparatus 107 further comprises a second arm 109 pivotally attached to arm 113. Pivoting of the second arm relative to the first arm is actuated by an actuator 109*a*. The second arm 109 pivots relative to the first arm 113 about a first pivot axis (X1, FIG. 12) orthogonal to a longitudinal axis of the arm 113. The clamp 106 is pivotally attached to the second arm 109, via a frame or member 117. Pivoting of the clamp relative to the second arm is actuated by an actuator 117*a*. The clamp 106 pivots relative to the second arm 109 about a second pivot axis (X2, FIG. 12) parallel to the first pivot axis X1. Thus, the positioning apparatus 107 is configured to raise and lower the clamp 106 and orient the clamp 106 to position the inner tube 4 carried by the clamp 106 with a longitudinal axis of the tube 4 coincident with a longitudinal axis of the drill string, by movement of the arm 113 laterally relative to the drill string and pivoting of the clamp 106 about the two spaced apart and parallel axes X1, X2. The pivot axes X1, X2 are orthogonal to the longitudinal axis of the drill string.

The illustrated embodiment further comprises a cam clamp 140. The cam clamp 140 is in fixed relation to the clamp 106 and is aligned with and axially spaced from the clamp, such that an inner tube is received through both the clamp 106 and the cam clamp. In the illustrated embodiment both the clamp 106 and cam clamp 140 are mounted to the frame 117. Thus, the cam clamp 140 is moveably supported by the positioning apparatus 107 to move together with the clamp 106 as described above.

Figure 14:
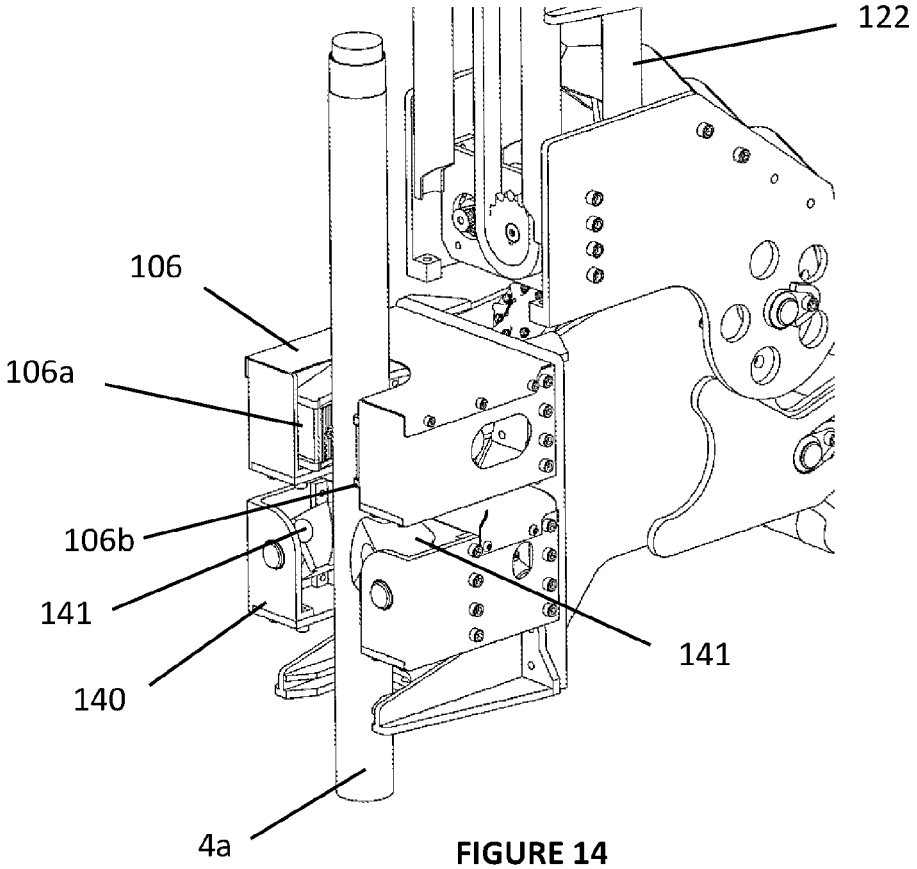
FIG. 14 illustrates a clamp and slip clamp of the device of FIG. 9.
Figure 22:
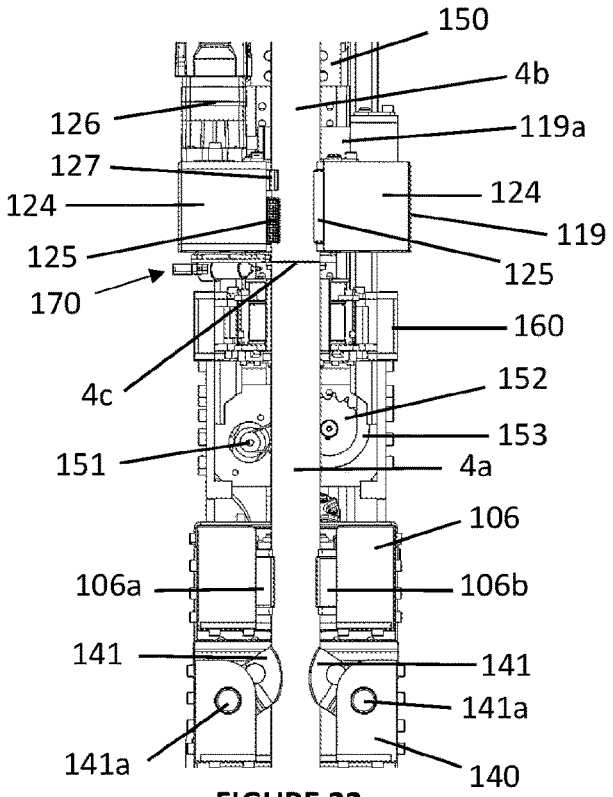
FIG. 22 is an end view of a portion of the device of FIG. 9, showing the device clamping a lower inner tube and an upper inner tube prior to uncoupling the tubes.

The cam clamp 140 is configured to stop the inner tubes 4 from being accidentally dropped down the drill string 3. With reference to FIGS. 14 and 22, the cam clamp 140 comprises a pair of jaws 141. The jaws 141 are mounted to pivot about respective pivot axes 141*a* orthogonal to the longitudinal axis of the inner tube when received through the cam clamp 140. The jaws 141 are biased to pivot inwardly so that in use the jaws 141 are in contact with the inner tube received though the cam clamp 140 and clamp 106. The jaws 141 may be biased by gravity and/or a biasing element such as a spring/hydraulic actuator (not shown). The jaws are in constant contact with the inner tube and rub against the inner tube as it is withdrawn from the drill string (i.e. the inner tube can slip through the jaws 141 when retrieved from the drill string), and due to their geometry are designed to cam towards a clamped position by friction contact between the inner tube and the jaws by relative movement of the inner tube into the drills string, i.e. should the inner tube(s) fall downwards (e.g. accidentally released from the clamp 106). The jaws grip the inner tube by the weight of the tube acting downwards to bias the jaws inwards against the inner tube.

The pair of jaws 141 of the cam clamp 140 must be held open in an open position when inner tubes are being lowered down the drill string. For example, the cam clamp comprises one or more actuators such as hydraulic actuator(s) (not shown) configured to move the jaws 141 between a close position and an open position. In the close position, the hydraulic actuator(s) maintains a positive force or contact between the jaws and the inner tube, so that movement of the inner tube into the drill string causes the jaws to cam inward against the inner tube to grip the inner tube, and movement of the inner tube out of the drill string allows sliding movement between the inner tube and the jaws. In the open position the jaws 141 may not contact the inner tube. In the open configuration the jaws present a laterally facing mouth or opening to receive a portion of the inner tube laterally into the cam clamp, to be clamped or gripped between the jaws when the jaws are in a close position to contact the tube and grip the tube should the inner tube move downwards.

Figure 15:
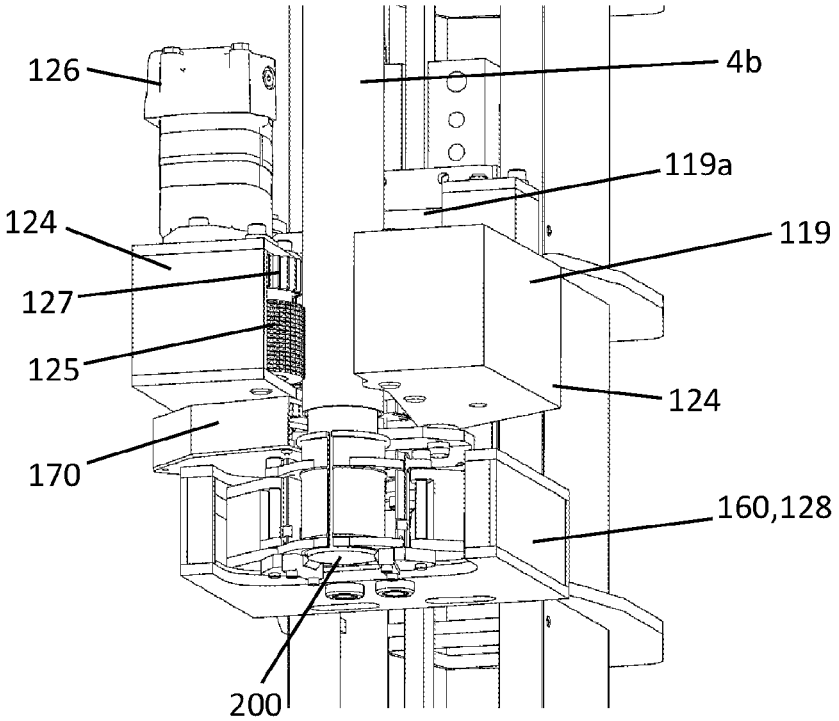
FIG. 15 illustrates a coupling mechanism and core clamp of the device of FIG. 9.
Figure 17:
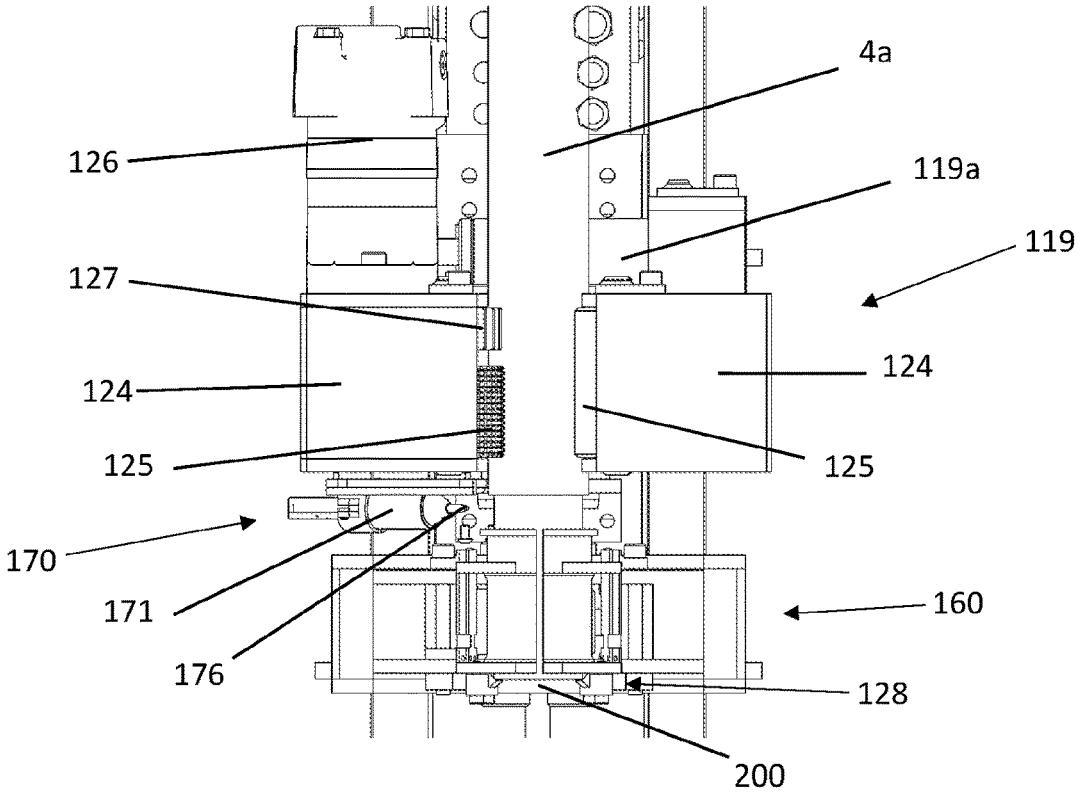
FIG. 17 illustrates a coupling mechanism and core clamp of the device of FIG. 9.

The device 101 further comprises a coupling mechanism 119. As best shown in FIGS. 15, 17 and 22, the coupling mechanism 119 comprises a pair of jaws 124 configured to open and close, as described above for the coupling mechanism 119 of the earlier embodiment 1. In the open configuration the jaws 124 present a laterally facing mouth or opening to receive a portion of the inner tube laterally into the coupling mechanism, to be clamped or gripped between the jaws when the jaws are in the close configuration. In the illustrated embodiment the jaws 124 are moved open and closed by an actuator (hydraulic ram) 119*a*. Each jaw pivots to open and close about a pivot axis parallel to the longitudinal axis of the inner tube when received in the coupling mechanism 119. Alternatively, the coupling mechanism may have jaws configured to move/slide in a direction orthogonal to the longitudinal axis of the inner tube to move between the open and close positions. Each jaw 124 comprises rollers 125. In the Figures one roller 125 of each jaw 124 is hidden from view. With the jaws closed the rollers engage the inner tube Labelled variously as 4A and 4B In this embodiment, the roller of one jaw is rotated by a drive mechanism, i.e. hydraulic motor 126 via gear 127, to drive rotation of the inner tube 4 to thereby uncouple (or couple) the upper most inner tube 4*b* from the adjacent lower inner tube 4*a*. Additional rollers may be driven. One or more of the rollers 125 may be knurled or otherwise textured to grip the inner tube.

The coupling mechanism 119 is supported by a positioning apparatus 107, 120 to move the coupling mechanism 119 relative to the drill rig 2 and drill string 3, and relative to the clamp 106, to position the coupling mechanism 119 about the inner tube 4*b* to engage the inner tube 4*b* to uncouple (or couple) the inner tube 4*b* from (or to) the adjacent lower inner tube 4*a*. The positioning apparatus 107, 120 comprises the positioning apparatus 107 (the first positioning apparatus) and a second positioning apparatus 120.

The second positioning apparatus 120 is coupled to the first positioning apparatus 107. The first positioning apparatus 107 is configured to move the clamp 106 and the coupling mechanism 119 relative to the drill string 3, to position the clamp 106 to grip the lower inner tube 4*a* and position the coupling mechanism 19 axially spaced from the clamp 106 to engage the upper inner tube 4*b* or joint. The second positioning mechanism 120 is configured to move the coupling mechanism 119 relative to the clamp 106, to engage the upper inner tube 4*b*.

The second positioning apparatus 120 movably couples the coupling mechanism to the clamp 106, to pivot relative to the clamp 106 between a raised position (e.g. FIG. 9) and a lowered position (e.g. FIG. 10). The coupling mechanism 119 pivots relative to the clamp 106 about a third pivot axis (X3, FIG. 12) parallel to the first and second pivot axes X1, X2. Thus, the clamp 106 and the coupling mechanism 119 both pivot in a plane (i.e. the same plane) about the respective pivot axes X1, X2 and X3.

Figure 12:
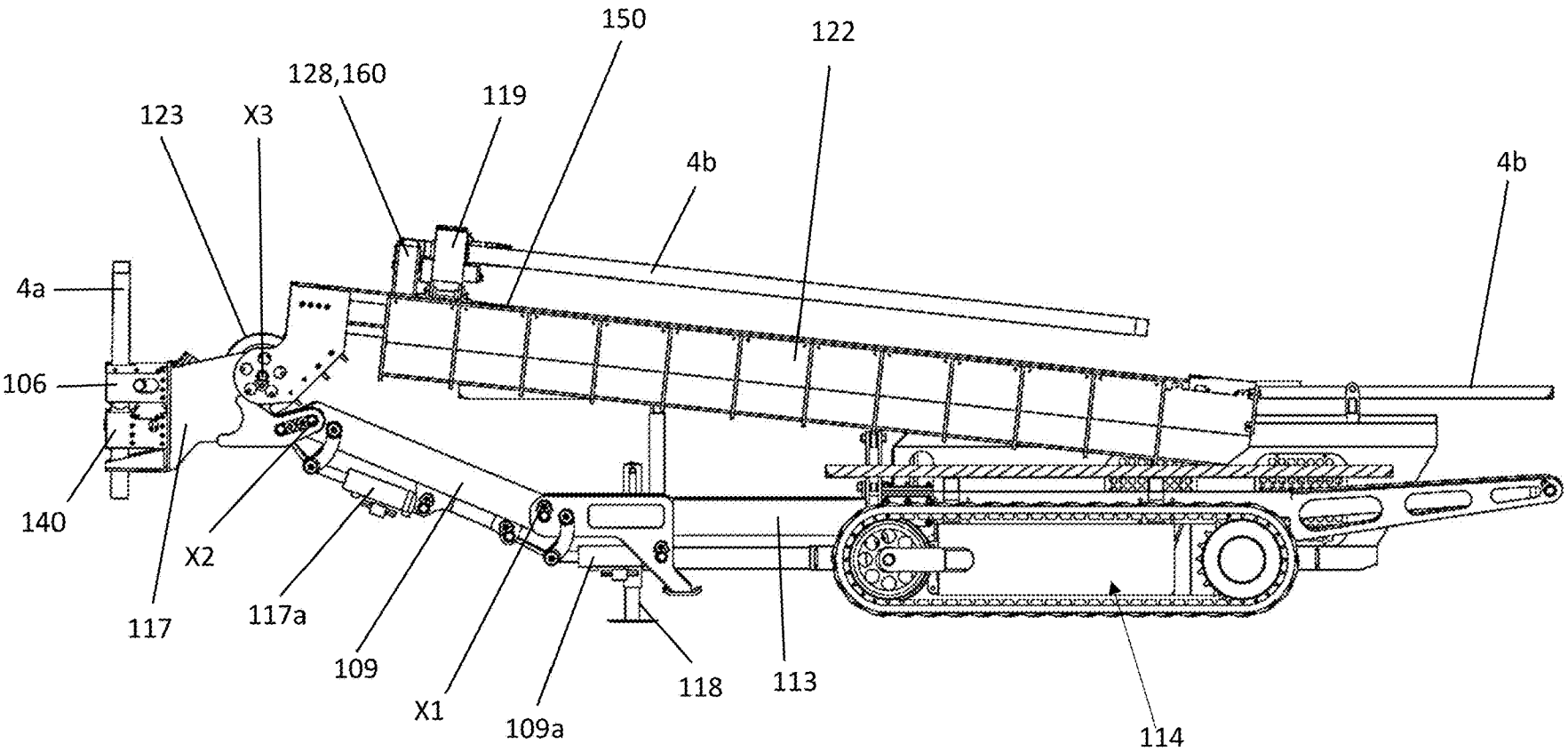
FIG. 12 is a side view of the device of FIG. 9 with the mast down.

In the raised position, the coupling mechanism 119 is axially spaced from and aligned with the clamp so that an inner tube received in the coupling mechanism is aligned with an inner tube received in the clamp 106. In the lowered position, the device 101 presents an inner tube received in the coupling mechanism 119 in a substantially horizontal position, i.e. lowered onto the support platform provided by the vehicle 114, as shown in FIG. 12. This allows for an inner tube with core to be safely removed from the device 101, or for an empty inner tube to be loaded into the coupling mechanism 119.

In the illustrated embodiment, the second positioning apparatus comprises a mast 122 pivotally attached to the first positioning apparatus 107. The mast is pivotally attached to the frame 117. The coupling mechanism 119 is mounted to move axially along the mast 122 to move independently of the clamp 106. With the mast 122 in the raised position, the coupling mechanism 119 is axially spaced from and aligned with the clamp 119, and when in the lowered position, the mast with coupling mechanism 119 presents an inner tube 4 in the substantially horizonal position. The coupling mechanism 119 may be mounted to a carriage or frame 150 driven along the mast 122 by a motor 151 and chain or belt drive comprising a sprocket/pulley 152 and belt or chain 153, or some other suitable mechanism, such as a hydraulic ram. The carriage or frame 150 may move on the mast on bearings or rollers or the like.

One or more actuators (e.g. rotary actuator 123) may be provided to raise/lower the mast 122/second positioning apparatus 120 with coupling mechanism 119 supported thereon. One or more sensors such as a rotary encoder in communication with a controller, such as a programmable logic controller, may be provided so that after an initial setup the coupling mechanism 119 and associated mast 122 can easily and repeatably be raised/lowered to align the inner tube carried by the coupling mechanism 119 with the drill string 3 when in the raised position with a minimum of intervention.

Figure 13:
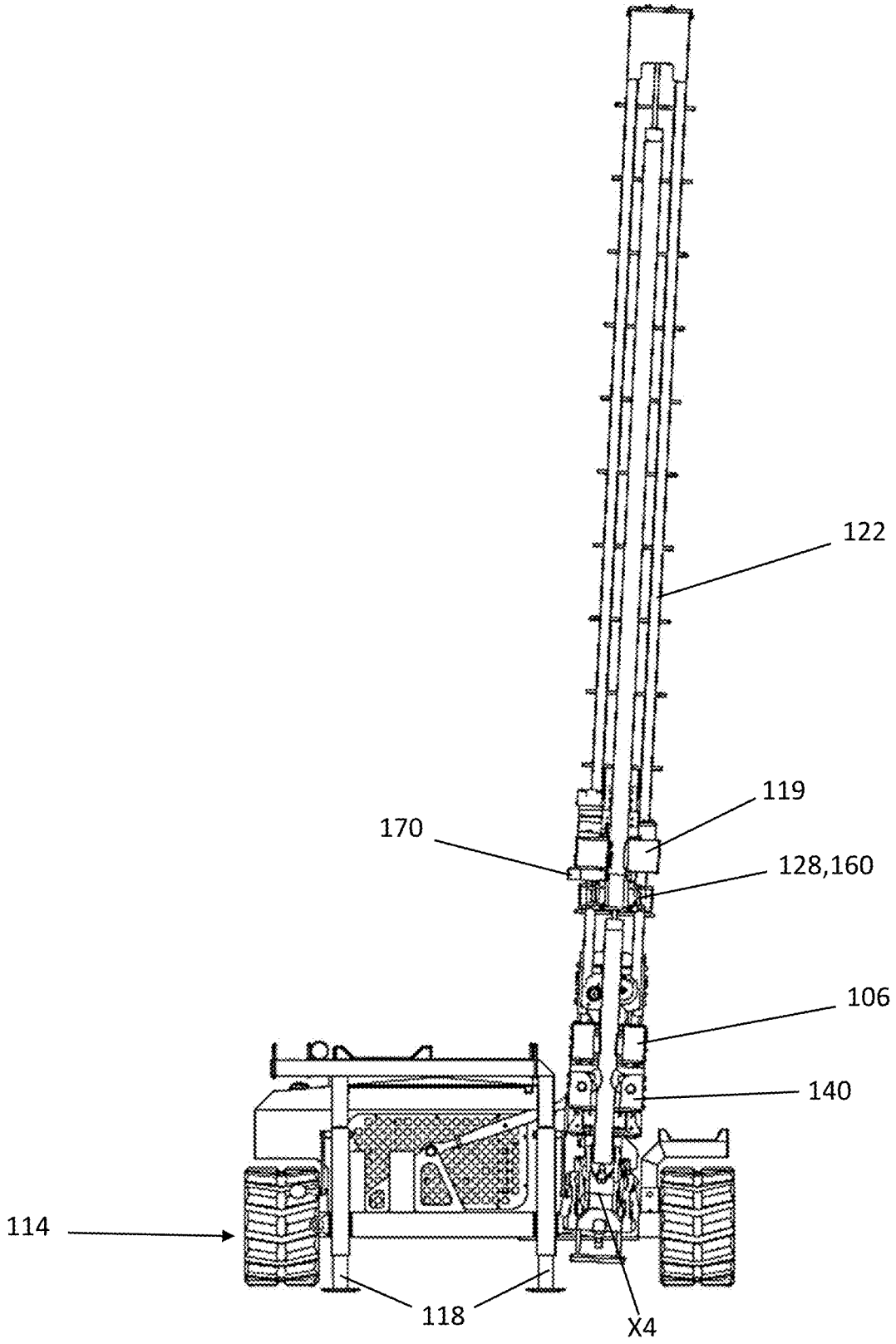
FIG. 13 is an end view of the handling device of FIG. 9 showing the mast canting to one side of vertical.

As shown in FIG. 13, the arm 113 is pivotally mounted to the vehicle 114 to pivot about a pivot axis X4 orthogonal to the first and second pivot axes X1, X2. The positioning apparatus 107 and therefore clamp 106 is therefore mounted to pivot about the fourth pivot axis X4. This allows for the clamp 106 and the mast carrying the coupling mechanism 119 to cant sideways either side of vertical. This canting movement about the fourth pivot axis may be accomplished by manual adjustment or by a powered actuator such as a hydraulic actuator. Movement of the clamp 106 about the three pivot axes X1, X2 and X4 allows for an inner tube carried by the clamp 106 to be aligned with the drill string, to allow an inner tube to be inserted into and withdrawn from the drill string The illustrated embodiment 101 further comprises a core support clamp 160. The core support clamp 160 is in fixed relation to the coupling mechanism 119 and is aligned with and axially spaced from the coupling mechanism 119, such that an inner tube 4 is received through both the coupling mechanism 119 and the core clamp 160. In the illustrated embodiment both the coupling mechanism 119 and the core clamp 160 are mounted to the mast 122 to move along the mast together. For example, the coupling mechanism 119 and core clamp 150 are mounted on a common frame or carriage 150 that moves along the mast. The core support clamp 150 is located on the mast 122 below the coupling mechanism 119.

Figure 16:
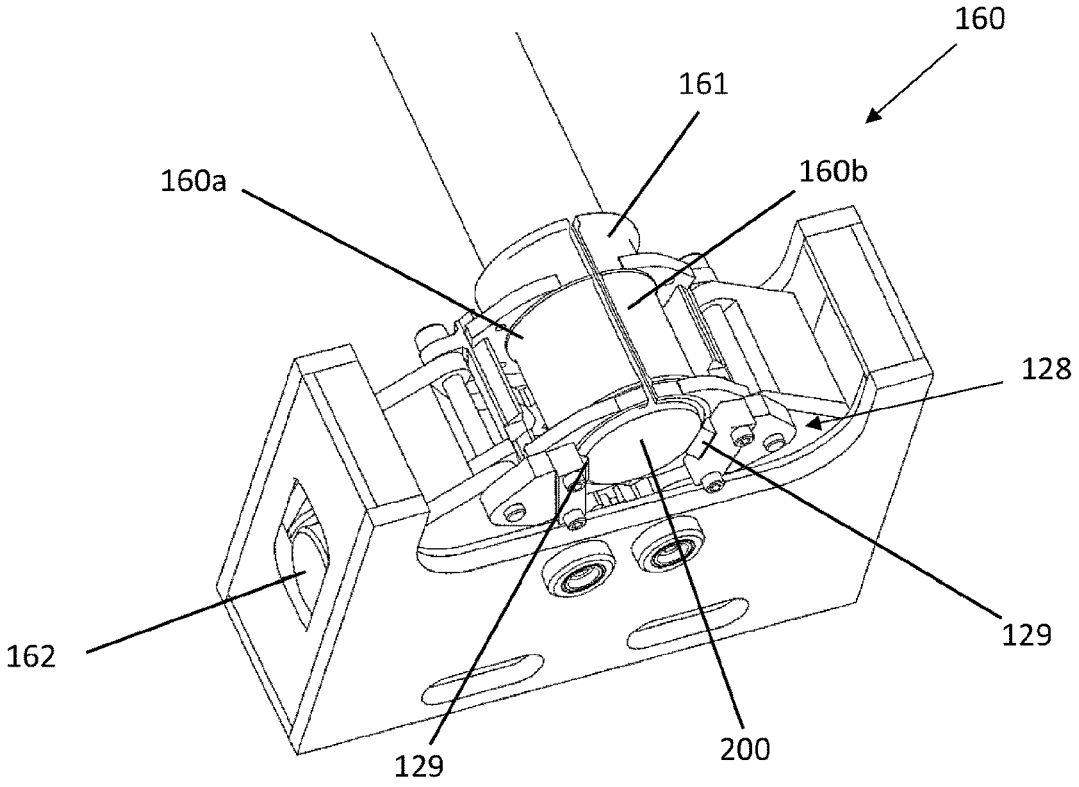
FIG. 16 illustrates a core clamp and breaking mechanism of the device of FIG. 9.

With reference to FIG. 16, the core clamp comprises a pair of jaws 160*a*, 160*b* configured to open and close, and are operated between clamped and unclamped positions by an actuator 162 (e.g. hydraulic). Each jaw pivots to open and close about a pivot axis parallel to the longitudinal axis of the inner tube and core when received in the clamp 160.

Alternatively, the core clamp may have jaws configured to move/slide in a direction orthogonal to the longitudinal axis of the inner tube to move between the open and close positions. The jaws of the core clamp 160 may be lined with a resilient material such as a rubber material 161 so as to not damage the core when being gripped with the jaws 160*a*, 160*b* in the closed position. In the closed position the core clamp grips and supports an exposed portion of the core to prevent the core from falling out of the inner tube 4 once the core has been cut or broken, as described below.

The illustrated embodiment further comprises a cutting or breaking mechanism (herein breaking mechanism) 128 configured to cut through or break an exposed portion of the core sample when recovering the core sample, as described below.

The breaking mechanism 128 is mounted adjacent to and below the coupling mechanism 119. The breaking mechanism 128 is in fixed relation to the coupling mechanism 119 and moves along the mast 122 together with the coupling mechanism. In the illustrated embodiment, the breaking mechanism 128 comprises a chisel 129 mounted to each jaw of the core support clamp 160. The chisels 129 are mounted at or adjacent a lower edge of the jaws 160*a*, 160*b* of the core clamp 160 and project inwards of the jaws 160*a*, 160*b*. When the jaws of the core clamp 160 are moved to the closed position to grip the exposed portion of the core, the chisels move from a retracted position to an extended position to extend into a surface of the core to break the core. The chisels 129 may also support the core together with the jaws 160*a*, 160*b* to prevent the separated core from falling out of the inner tube 4 carrying the core. In an alternative embodiment one or more chisels may be provided to one jaw only.

The device 101 also comprises a marking mechanism 170, configured to provide a longitudinal mark to the exposed portion of the core sample prior to cutting or breaking the core with the breaking mechanism 128. The breaking mechanism cuts or breaks the core across the mark so that a portion of the mark remains on the core on each side of the cut or break. The mark on each cut portion of the core can subsequently be used to identify an orientation between adjacent portions of the core.

The marking mechanism 170 is located axially between the coupling mechanism 119 and the breaking mechanism 128/core clamp 160 and is in fixed relation to the coupling mechanism 119 to move along the mast 122 together with the coupling mechanism 119. For example, the coupling mechanism and the marking mechanism are mounted on the frame or carriage 150 that moves along the mast.

Figure 18:
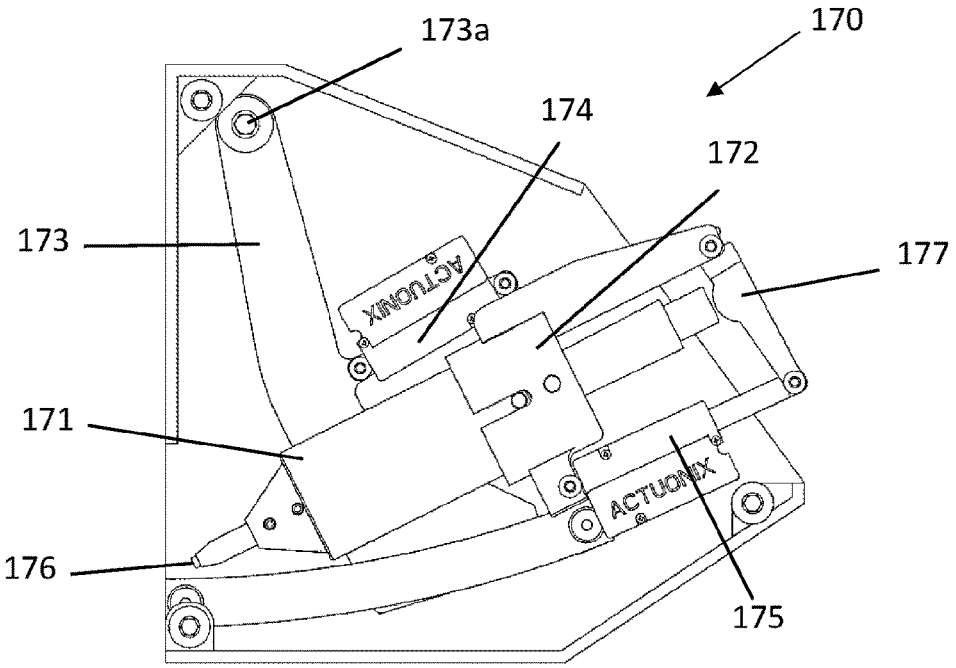
FIG. 18 illustrates a marking mechanism of the device of FIG. 9.

With reference to FIG. 18, the marking mechanism comprises a marker 171, such as a pen or scribe. The illustrated embodiment comprises a pen 171. The marker 171 is movably mounted to move towards and away from the longitudinal axis of the inner tubes to advance against the exposed portion of the core and retract from the exposed portion of the core. The marker is mounted in a housing 172. The marker is supported via the housing 172 on an arm 173 to pivot between the extended and retracted positions by actuation of actuator 174. The arm pivots on a pivot axis 173*a* parallel to the longitudinal axis of the inner tube when clamped by the coupling mechanism 119. The actuator advances the marker 171 against the core in a gentle arc.

As the coupling mechanism 119 separates adjacent inner tubes to expose a portion of the core, the marking mechanism 170 provides a longitudinal mark on the core sample. Once the coupling mechanism 170 stops moving along the mast, the actuator 174 retracts the marker 171 away from the core sample. A second actuator 175 advances a marking material 176 of the marker 171 for subsequent use. In the illustrated embodiment, the second actuator 175 moves the marker 171 further away from the core to press the marking material (i.e. a pencil 'lead') of holder carrying the marking material against a stop 177 to advance the marking material 176 relative to a body 178 of the marker 171 for subsequent markings.

In some embodiments the cutting/breaking mechanism may leave a witness mark on the core sample to assist with identifying an orientation between adjacent portions of the core during analysis. In such an embodiment, a marking mechanism may not be required. A breaking mechanism that acts to break or fracture the core by applying a compression load to one or both sides of the core, for example via chisel 129, may be preferred over a mechanism that cuts the core, e.g. by a saw blade, since the load applied to the surface of the core and/or break or fracture of the core is more likely to leave a clear witness mark since each break or fractures is unique.

A method for drilling and recovering core samples from a formation with reference to the device 101 is now described. With the mast 122 in the lowered position, an operator loads a first inner tube 4*a* to the coupling mechanism 119. The coupling mechanism is actuated to clamp or grip the inner tube 4*a*. The mast is moved to the raised position and the positioning mechanism 107 is manipulated to align the clamp 106, coupling mechanism 119 and inner tube 4*a* with the longitudinal axis of the drill string 3. The coupling mechanism 119 is moved down the mast to insert the inner tube 4*a* into the drill string 3. The drill string 3 is clamped by the rig foot clamp 5. Once inserted, the inner tube 4*a* is gripped by the clamp 106 or the cam clamp 140 and the coupling mechanism 119 is actuated to release the inner tube 4*a*. Several movements of the coupling mechanism down/up/down the mast may be required to set the inner tube in the drill string with an upper end of the inner tube 4*a* exposed above the top of the drill string.

Figure 19:
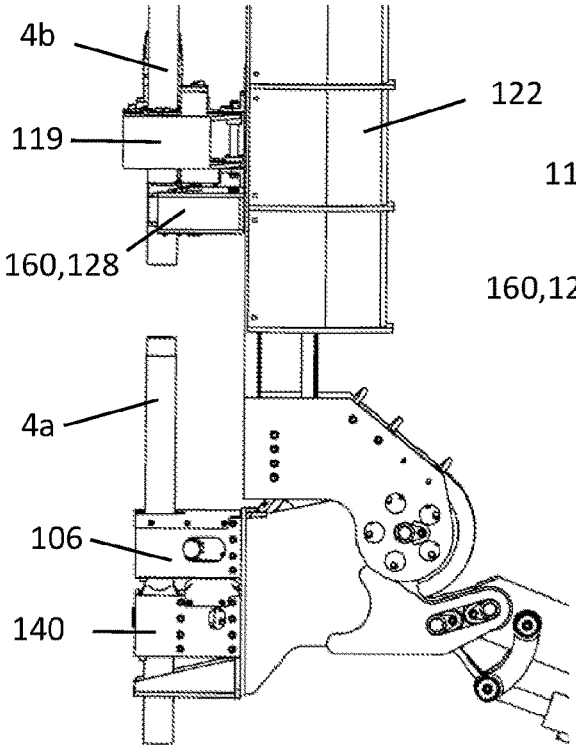
FIG. 19 is a side view of a portion of the device of FIG. 9, showing the device clamping a lower inner tube and an upper inner tube prior to coupling the tubes together.
Figure 20:
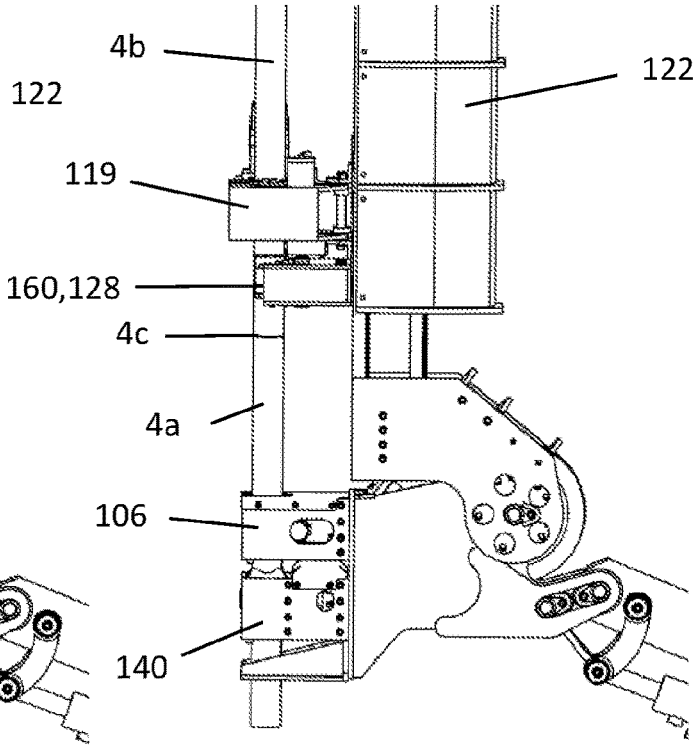
FIG. 20 is a another side view showing the lower inner tube and upper inner tube coupled together.

The clamp 106 is actuated to clamp or grip the upper end of the inner tube 4*a* to hold the inner tube relative to the drill string 3 and prevent the inner tube 4*a* from rotating. The next inner tube 4*b* is then loaded in the same way as the first inner tube 4*a*, as illustrated in FIG. 12. The mast 122 is moved to the raised position to align the upper inner tube 4*b* with the tube 4*a* already received in the drill string 3, as shown in FIG. 19. An operator operates the coupling mechanism 119 to move the coupling mechanism along the mast and rotate the upper inner tube 4*b* to couple the upper tube 4*b* to the adjacent lower tube 4*a*, as shown in FIG. 20. One or more position sensors may be provided to accurate position the coupling mechanism on the mast 122. For example, position sensors (not shown) may sense the position of the upper tube and or lower tube to ensure accurate connection of the two tubes.

Once the inner tubes 4*a*, 4*b* are coupled together, the coupling mechanism 119 and the clamp 106 are actuated to release the coupled inner tubes, and the coupled inner tubes are lowered into the drill string 3, for example by wireline.

Where more than two inner tubes are required, the coupled tubes are lowered until the top of the upper most tube 4*b* is adjacent the top of the drill string 3. This may be achieved by actuating the coupling mechanism 119 to release the inner tube 4*a*, and then moving the coupling mechanism up the mast, to then be actuated to clamp the inner tube near to an upper end of the inner tube. The clamp 106 is then operated to release the inner tube 4*b*, and the coupling mechanism is moved down the mast to insert the inner tube string 4*b*, 4*a* into the drill string until the coupling mechanism is adjacent the top of the drill string. The clamp 106 is operated to clamp the exposed upper end of the uppermost tube 4*a* received in the drill string 3, and the coupling mechanism 119 is operated to release the upper most inner tube 4*a*. The mast 122 may be lowered to allow the next inner tube to be loaded and the method of coupling the inner tubes is repeated until a desired length of inner tube string is achieved.

A wireline may then be connected to the top tube of the inner tube string, via a spear point assembly (180 FIG. 26) attached to the upper end of the inner tube string, and the inner tube string may then be lowered into the drill string 3 until the inner tube string reaches the bottom of the drill string in the known way. The drill operation commences with the drill rig connecting a new length of drill rod 3 into the drill rig mast and the rotational unit 111 (a top drive in the illustrated embodiment) of the drill rig 2 rotating and advancing the drill string 3 with the inner tube string received therein into the formation.

Figure 21:
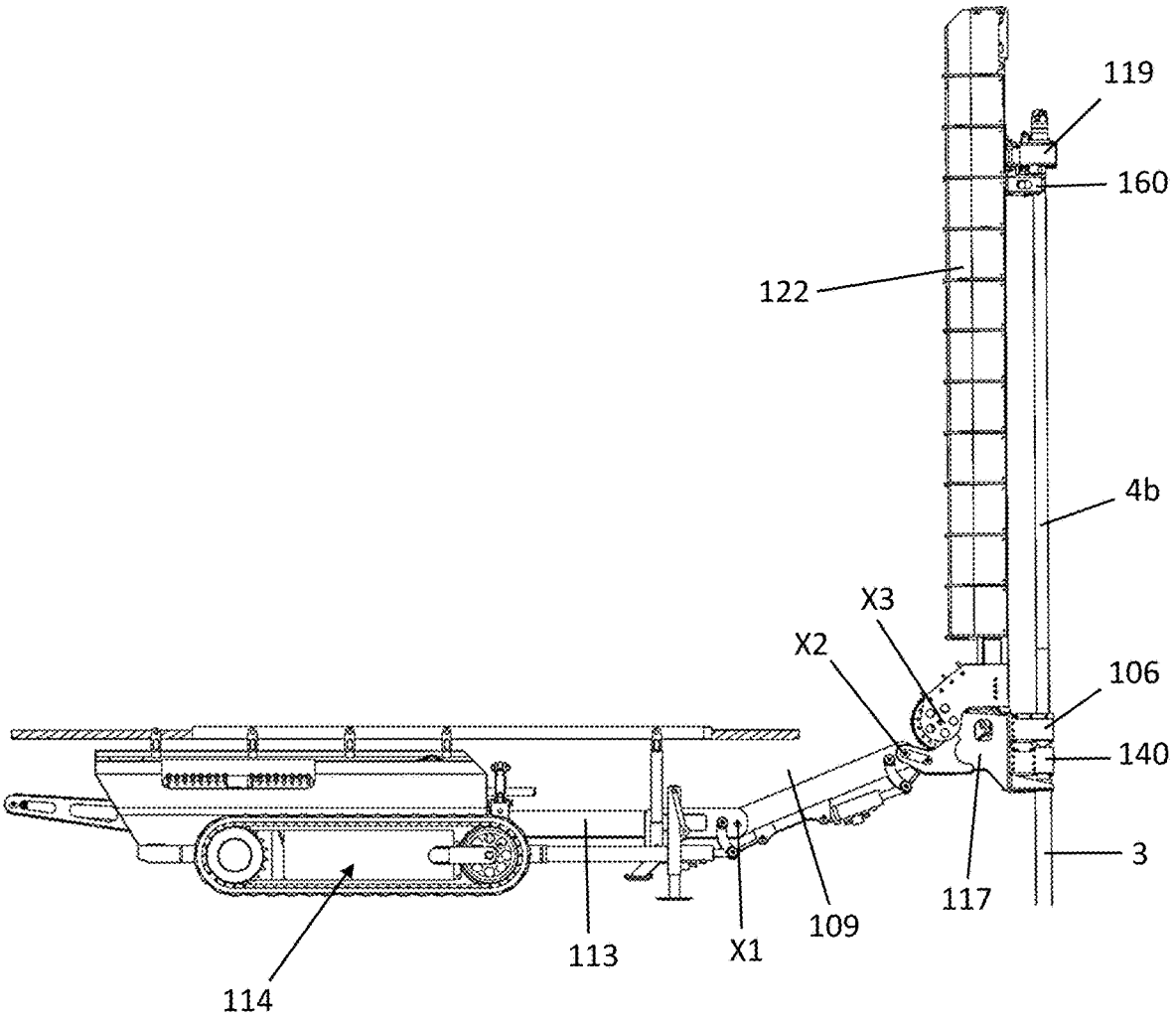
FIG. 21 is a side view of the device of FIG. 9 with the coupling mechanism moved up the mast to lift an inner tube string from a drill string.

Once the drill string 3 has been advanced for a desired distance by the drilling rig in the known way, for example a distance equal to (or less than) the length of the inner tube string, drilling ceases and the inner tube string comprising at least two inner tubes 4*a*, 4*b* and core sample contained therein is recovered to the surface via a wireline. The inner tube string may be recovered until an upper end of the inner tube string is exposed above the top end of the drill string 3. The clamp 106 may be actuated to clamp the top of the inner tube string. The coupling mechanism 119 may be moved on the mast 122 to align with an overshot assembly (183, FIG. 26) connecting the wireline to the spear point assembly 180 at the top of the inner tube string. The coupling mechanism 119 may be used to squeeze latch arms 184 of the overshot assembly 183 to release the wireline from the inner tube string to allow the wireline to be retrieved. The inner tube string may be held by the clamp 106, or the cam clamp 140 may operate to hold the inner string with the clamp 106 open. The coupling mechanism 119 is then moved on the mast to receive the uppermost inner tube and is actuated to clamp the inner tube string. With clamp 106 unclamped from the inner tube string, the coupling mechanism 119 may be moved up the mast to expose the upper most joint 4*c* of the inner tube string above the top end of the drill string 3, as shown in FIG. 21.

The clamp 106 is then actuated to clamp the inner tube below the joint and the coupling mechanism 119 is actuated to unclamp the inner tube string and is moved on the mast 122 to position the coupling mechanism 119 above the joint 4*c* and with the marking 170 and/or cutting/breaking mechanism 128 adjacent the joint 4*c*. The coupling mechanism 119 is actuated to grip the upper most inner tube 4*b* above the joint 4*c* and with the marking 170 and cutting/breaking mechanism 128 adjacent the joint 4*c*, as shown in FIG. 22.

Alternatively, the inner tube string may be recovered via wireline until the upper most joint 4*c* of the inner tube string is exposed above the top end of the drill string 3. The clamp 106 may be actuated to clamp or grip the upper end of the second uppermost inner tube. The coupling mechanism 119 may be used to squeeze arms of the overshot mechanism to release the wireline. The coupling mechanism 19 is then moved on the mast to position and the coupling mechanism as shown in FIG. 22.

The coupling mechanism 119 is then actuated to rotate the upper most inner tube 4*b* to uncouple the uppermost tube from the adjacent second upper most tube 4*a*. The coupling mechanism moves along the mast 122 as it rotates the upper inner tube 4*b* to uncouple the inner tubes.

Figure 23:
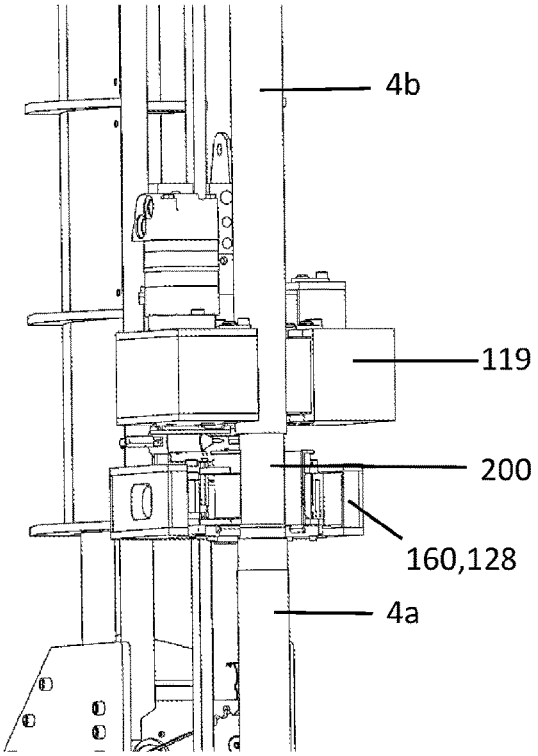
FIG. 23 illustrates a portion of the device of FIG. 9, showing the device clamping a lower inner tube and an upper inner tube with the tubes uncoupled and separated to expose a core sample held by the tubes.

Once the upper most tube is uncoupled, the coupling mechanism 119 with clamped upper most inner tube 4*b* is moved up the mast 122 to move the upper most tube 4*a* upwards along the longitudinal axis of the drill string, to separate the upper most tube 4*b* from the adjacent second upper most tube 4*a* to expose a portion of the core sample 200 between the upper most and second upper most tubes, as shown in FIG. 23. The marker mechanism 170 is actuated to advance the marker against the core 200, so that as the upper most tube 4*b* is separated from the second upper most tube 4*a*, the marker mechanism 170 provides a longitudinal mark to the exposed portion of the core 200.

Figure 24:
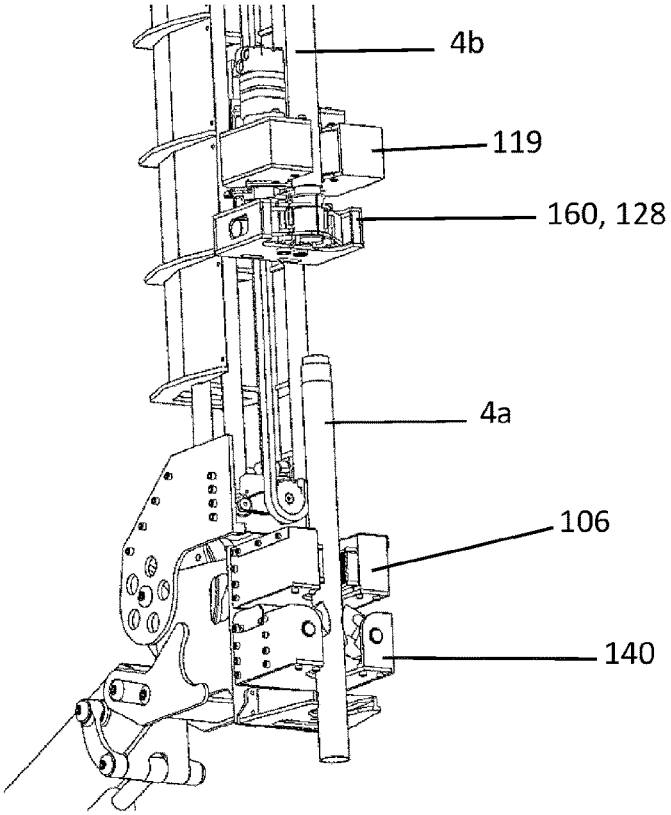
FIG. 24 illustrates a portion of the device of FIG. 9, showing the device clamping the lower inner tube and the upper inner tube with the tubes uncoupled and separated to separate portions of the core held in each inner tube.

The core clamp 160 is actuated to clamp or grip the exposed portion of the core 200, and the breaking mechanism 128 breaks the core 200 through the exposed portion of the core sample. The core is cut or broken across the mark on the core from the marking mechanism 170, so that recovered adjacent pieces of the core can be realigned during later analysis by geologists. The coupling mechanism 119 may be moved axially up the mast 122 to separate the upper most tube with core from the next upper most tube, as shown in FIG. 24.

Figure 25:
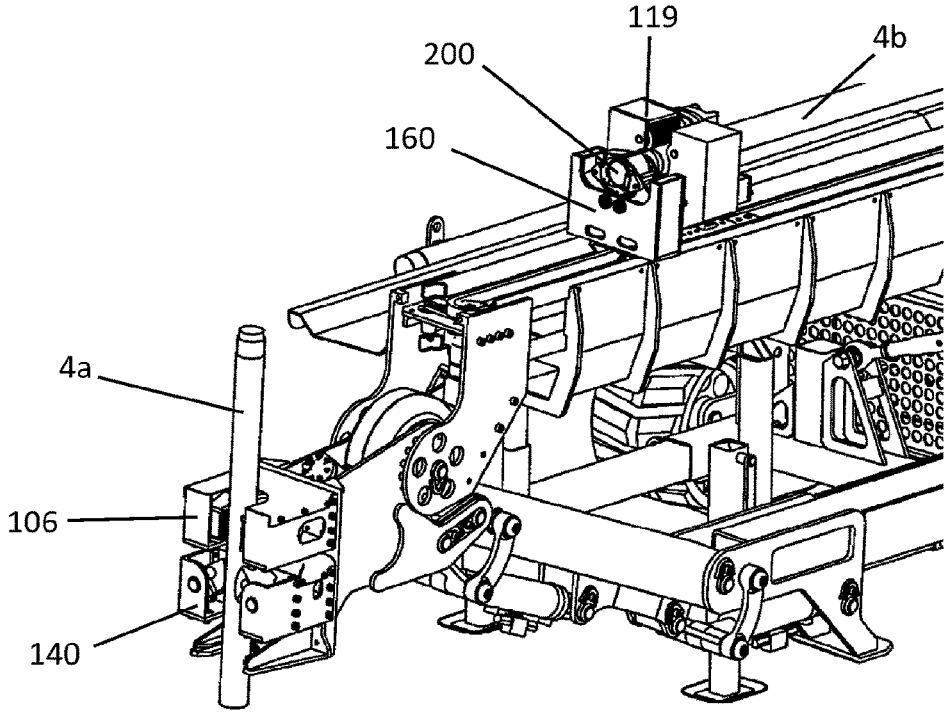
FIG. 25 illustrates a portion of the device of FIG. 9, showing the mast in the lowered position with an inner tube with core sample presented for removal from the device.
Figure 26:
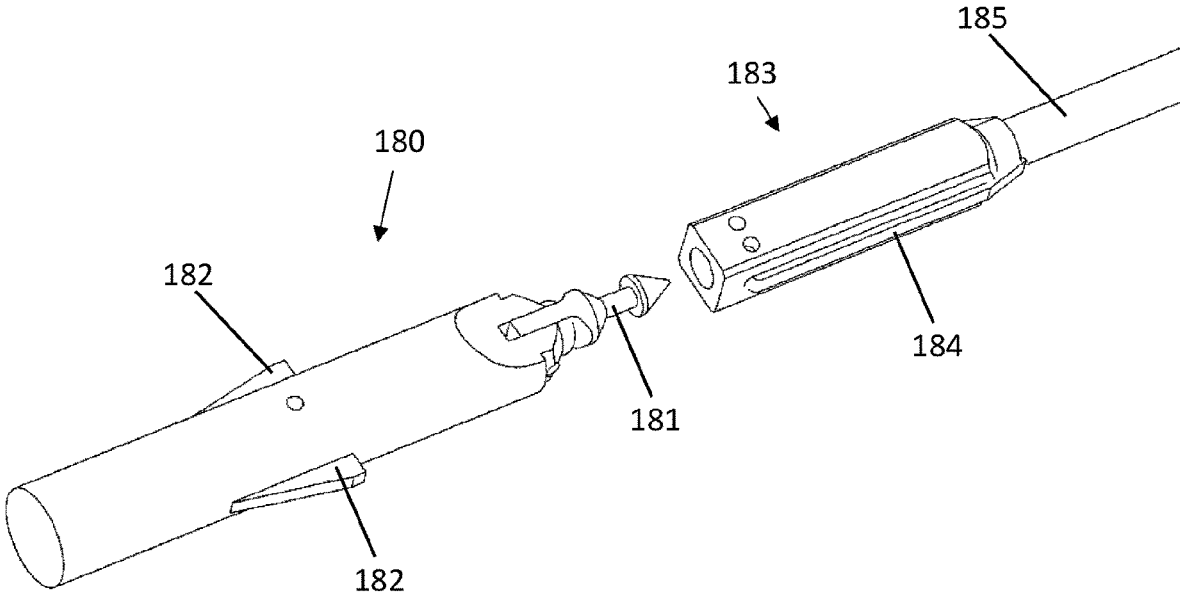
FIG. 26 illustrates a portion of the coupling mechanism of FIG. 9.

The mast 122 is rotated away from the longitudinal axis of the drill string to the lowered position as shown in FIG. 25, to present the inner tube 4*b* and core received therein at a comfortable working height for an operator to safely handle the heavy inner tube with core. The coupling mechanism 119 and core clamp 160 are actuated to release the inner tube and core and an operator may unload the inner tube and core from the device. A robotic arm (not shown) may be provided to unload the inner tube, and/or the mast may rotate on its longitudinal axis to one or both sides to assist with unloading and loading of inner tubes. The operator removes the core 200 from the inner tube 4*b* and stores the inner tube for a subsequent drilling cycle.

To remove the next upper most core, the mast 122 is moved to the raised position, to align the coupling mechanism 119 with the longitudinal axis of the drill string 3. The coupling mechanism 119 may be moved down the mast 122 to receive the top of the next inner tube 4*a*, and then actuated to clamp to the next inner tube. The clamp 106 may then release the inner tube, and the coupling mechanism may be moved along the mast 122 to lift the inner tube from the drill string to expose the next joint between the inner tubes, as described above with reference to FIG. 21. The clamp 106 may then be closed to grip the second upper most inner tube 4*a* below the joint, and the coupling mechanism 119 operated to release the upper most inner tube. The coupling mechanism is moved down the mast 122 and then actuated to clamp the upper most inner tube 4*b*, with the marking mechanism and breaking mechanism adjacent the inner tube joint 4*c*. The operation to uncouple the inner tubes and break or cut the core is then repeated.

The operation of lifting the remaining string of inner tubes to expose the upper most joint above the drill string 3, uncoupling and separating the upper most inner tube, marking and cutting/breaking the exposed portion of core sample, and removing the upper most inner tube with corresponding portion of core sample from the rig is repeated until a single lower most inner tube is left in the drill string. The last inner tube with corresponding portion of core sample is lifted from the drill string, by the coupling mechanism 119, and removed from the drill rig, to complete the drilling cycle. A new drilling cycle can then be commencing, by stringing together inner tubes and lowering the string to the bottom of the drill string as described above.

The devices 1, 101 are described above by way of example. It should be noted that in some embodiments, the coupling mechanism, core support clamp, cutting or breaking mechanism and the marking mechanism may not traverse along the mast, or may not traverse along the mast together. The device may comprise another clamp that traverses along the mast to move the inner tubes along the longitudinal axis of the drill string, or a wireline may be used, so that the coupling mechanism and associated mechanism do not need to move along the mast. The mast may therefore be relatively short, i.e. in the order of 1 or 2 meters long. The vehicle 114 may not be powered to move over a ground or rig surface, for example may include skids to be dragged or pushed by another vehicle or may be without a movable vehicle or base. For example, the device may comprise a base, and the clamp 106 and mast and connected assemblies may be movably mounted to the base. The device may be incorporated into a drill rig, i.e. the drill rig may form or provide a base for the handling device. The handling device may be attached to and powered by the drill rig, i.e. hydraulic power may be provided by the rig.

Benefits

The time taken to couple inner tubes together to form a string of inner tubes, and retrieving the string of inner tubes, uncoupling, separating, cutting/breaking and unloading the inner tubes from the rig may take longer than handling a single inner tube. However, the time taken to retrieve an inner tube with core sample to the surface is significantly longer, such that a significant overall time saving is expected, with a resulting improvement in drill rig utilisation.

It should also be noted that in addition to the productivity benefits, there are significant safety advantages offered by the device 1— both in terms of manual handling of the core samples, but also in the decreased frequency of manual handling of single inner tubes—compared to the mechanical handling of multiple inner tubes presented at a safe working height to the drill rig crew.

Although this invention has been described by way of example and with reference to possible embodiments thereof, it is to be understood that modifications or improvements may be made thereto without departing from the spirit or scope of the appended claims.

The invention claimed is:

1. A drill rig which manipulates drill rods and a drill bit to advance a bore, comprising:

an inner tube handling system for the capture and retrieval of long core samples, via the use of a connected string of inner tubes located in the drill rods and which are connected and separated from one another in a hands free manner, the inner tube handling system comprising:

at least one clamp configured to either grip a lower or an upper inner tube on one side, of a joint between the lower inner tube and an adjacent upper inner tube of the string of inner tubes; and a cutting or breaking mechanism; and a coupling mechanism configured to:

engage the upper-or lower inner tube on either side of the joint, depending on which side of the joint the clamp is/are gripping an inner tube; and operate to uncouple the upper inner tube from the lower inner tube or vice versa depending on whether the upper or the lower inner tube is clamped;

wherein once the upper inner tube is uncoupled from the lower inner tube at least one positioning apparatus moves the coupling mechanism relative to the at least one clamp (or vice versa) to enable at least one of the inner tubes to move so as to allow a portion of the core sample held within the inner tubes to be exposed to enable cutting of the core sample by the cutting or breaking mechanism.

2. The drill rig as claimed in claim 1, wherein the device comprises a positioning apparatus configured to move the clamp relative to the drill string to engage an upper end of the lower inner tube.

3. The drill rig as claimed in claim 2, wherein the positioning device is configured to orient the clamp to position an inner tube carried by the clamp with a longitudinal axis of the tube coincident with a longitudinal axis of the drill string.

4. The drill rig as claimed in claim 1, wherein the coupling mechanism is configured to uncouple the upper inner tube from the adjacent lower inner tube or vice versa.

5. The drill rig as claimed in claim 1, wherein the cutting or breaking mechanism is configured to cut or break the exposed portion of the core between the upper and lower inner tubes after the upper and lower inner tubes have been uncoupled and separated.

6. The drill rig as claimed in claim 1, wherein the device comprises a marking mechanism to provide a longitudinal mark to an exposed portion of the core between the upper and lower inner tubes after the upper and lower inner tubes have been uncoupled and separated, to preserve a known orientation of adjacent portions of the core after cutting or breaking.

7. A method for drilling and recovering core samples from a formation, the method comprising:

i) providing a drill rig with a drill string for drilling into a formation to extract a core sample;

ii) a device for advancing an inner tube into the drill string to be received therein with an upper end of the inner tube exposed above a top end of the drill string;

iii) the device connects a next inner tube to the upper end of the inner tube received in the drill string to form a string of inner tubes comprising at least an uppermost inner tube and an adjacent second-uppermost inner tube;

iv) using the device to feed the connected string of inner tubes into the top of the drill string;

v) drilling into the formation to a depth greater than the length of a single inner tube of the string of inner tubes and less than or equal to a length of the string of inner tubes to receive the core sample within the string of inner tubes;

vi) recovering the string of inner tubes with core sample received therein and withdrawing the string of inner tubes to expose a lower end of the uppermost inner tube and an upper end of the adjacent second uppermost inner tube coupled thereto above the top end of the drill string with the second upper most inner tube received in the drill string;

vii) uncoupling and separating the uppermost inner tube from the adjacent second uppermost inner tube with the device to expose a portion of the core sample therebetween;

viii) cutting or breaking the core sample with the device through the exposed portion of the core sample by providing a cutting or breaking mechanism and operating the cutting or breaking mechanism to cut the exposed portion of the core; ix) using the device to remove the uppermost inner tube with a corresponding portion of the core sample therein from the drill rig while holding the core sample securely within the inner tube; and x) using the device to recover the second uppermost inner tube with a corresponding portion of the core sample therein from the drill string and removing from the drill rig.

8. The method of claim 7, wherein the string of inner tubes comprises more than one inner tubes and further wherein in step iii) the method comprises:

iii) a) coupling the next inner tube to the exposed upper end of the inner tube received in the drill string;

iii) b) advancing the coupled inner tubes into the drill string to be received therein with an upper end of an uppermost inner tube exposed above the top end of the drill string; and iii) c) repeating steps iii) a) and iii) b) until a desired number of inner tubes are coupled together to form the string of inner tubes.

9. The method of claim 7, wherein in step x) the method comprises: repeating steps vi) to ix) until an upper end of a lowermost inner tube of the string of inner tubes is above the upper end of the drill string; and recovering the lower most inner tube with a corresponding portion of the core sample therein from the drill string and removing from the drill rig.

10. The method as claimed in claim 7, wherein the method comprises providing a clamp and in step ii) the method comprises clamping the upper end of the inner tube.

11. The method as claimed in claim 7, wherein the method comprises providing a coupling mechanism configured to couple the inner tubes and in step iii) the method comprises: clamping the upper end of the inner tube exposed above the upper end of the drill string with the clamp, engaging the coupling mechanism with the next inner tube, and operating the coupling mechanism to couple the next inner tube to the upper end of the inner tube received in the drill string.

12. The method as claimed in claim 7, wherein in step vii) the method comprises: moving the uncoupled inner tube along an axis of the drill string to expose the portion of the core sample.

13. The method as claimed in claim 12, wherein in step viii) the method comprises: providing a means to mark the core sample and further wherein the cutting or breaking mechanism is configured to move between a retracted position and an extended position to cut or break the core, and in step viii) the method comprises:

after cutting or breaking the core, operating the cutting or breaking mechanism to remain in the extended position or move to an intermediate position to support a portion of the core sample above the cutting or breaking mechanism and retain the portion of the core sample in the uncoupled uppermost inner tube.

14. The drill rig as claimed in claim 5, wherein the cutting or breaking mechanism moves a blade to an extended position to cut or break the exposed portion of the core and then the blade remains in the extended position or moves to an intermediate position, following cutting or breaking the exposed portion of the core, so as to support that portion of the core sample above the blade and retain that portion of the core sample in the uncoupled upper inner tube.

15. The method as claimed in claim 7, wherein the cutting or breaking in step viii) is undertaken by extending a blade, and wherein after cutting the exposed portion of the core the blade remains in the extended position, or moves to an intermediate position, so as to support that portion of the core sample above the blade and retain that portion of the core sample in the uncoupled upper inner tube.

* * * * *